US010145131B2

(12) United States Patent
Hendricks

(10) Patent No.: US 10,145,131 B2
(45) **Date of Patent: *Dec. 4, 2018**

(54) FLEXIBLE, MULTI-CONFIGURATION CONCRETE FORM SYSTEM

(71) Applicant: Robert Hendricks, Youngstown, OH (US)

(72) Inventor: Robert Hendricks, Youngstown, OH (US)

(73) Assignee: Dinesol Plastics Inc., Niles, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/262,766

(22) Filed: Sep. 12, 2016

(65) Prior Publication Data

US 2017/0058540 A1 Mar. 2, 2017

Related U.S. Application Data

(63) Continuation-in-part of application No. 14/489,756, filed on Sep. 18, 2014, now Pat. No. 9,470,004, which is a continuation of application No. 12/661,445, filed on Mar. 16, 2010, now Pat. No. 8,919,726.

(60) Provisional application No. 61/339,017, filed on Feb. 26, 2010, provisional application No. 61/278,506, filed on Oct. 6, 2009, provisional application No. 61/210,564, filed on Mar. 19, 2009.

(51) Int. Cl.

| | |
|---|---|
| ***E04G 9/05*** | (2006.01) |
| ***E04G 17/14*** | (2006.01) |
| ***E04G 11/08*** | (2006.01) |
| ***E04G 11/06*** | (2006.01) |
| ***E04G 17/02*** | (2006.01) |
| ***E04G 11/10*** | (2006.01) |
| *E04G 9/02* | (2006.01) |
| *E04G 13/00* | (2006.01) |

(52) U.S. Cl.

CPC ..... *E04G 17/14* (2013.01); *E04G 9/05* (2013.01); *E04G 11/065* (2013.01); *E04G 11/08* (2013.01); *E04G 11/10* (2013.01); *E04G 17/02* (2013.01); *E04G 13/00* (2013.01); *E04G 2009/028* (2013.01)

(58) Field of Classification Search

CPC . E04G 13/00; E04G 2009/028; E04G 11/062; E04G 11/065; E04G 17/02; E04G 17/04; E04G 17/14; E04G 9/05

USPC .... 249/4, 6, 189, 192, 194; 52/787.1, 796.1, 52/DIG. 8, DIG. 12; 428/44, 119, 120; 312/265.6

See application file for complete search history.

(56) References Cited

U.S. PATENT DOCUMENTS

| | | | | |
|---|---|---|---|---|
| 1,495,305 A | | 5/1924 | Heltzel | |
| 1,839,286 A | | 1/1932 | Wolf | |
| 2,626,444 A | * | 1/1953 | Wolf et al. | 249/8 |
| 2,647,959 A | | 8/1953 | Mahoney | 179/178 |
| 2,661,516 A | | 12/1953 | Yates | 25/118 |

(Continued)

FOREIGN PATENT DOCUMENTS

| | | | |
|---|---|---|---|
| JP | 408128051 A | 5/1996 | E04G 17/14 |

*Primary Examiner* — Michael Safavi
(74) *Attorney, Agent, or Firm* — Robert G. Lev

(57) ABSTRACT

The present invention is directed to a flexible concrete form system having both flexible and rigid parts that are easily assembled and disassembled using a multi-contact point connection system. The concrete form system can be extended or stacked in a wide variety of configurations to accommodate almost any desired concrete shape.

17 Claims, 18 Drawing Sheets

(56) References Cited

U.S. PATENT DOCUMENTS

| | | | | | |
|---|---|---|---|---|---|
| 2,663,925 | A | | 12/1953 | Yates | 25/118 |
| 3,084,409 | A | | 4/1963 | Griffiths | 24/132 |
| 3,288,426 | A | | 11/1966 | Simpson | 249/192 |
| 3,785,606 | A | * | 1/1974 | Green | 249/3 |
| 4,340,200 | A | * | 7/1982 | Stegmeier | 249/3 |
| 4,544,324 | A | | 10/1985 | Hornung | 414/785 |
| 4,579,312 | A | | 4/1986 | White | 249/6 |
| 4,712,764 | A | | 12/1987 | White | 249/6 |
| 4,750,703 | A | | 6/1988 | Gentilcore et al. | 249/6 |
| 4,824,068 | A | * | 4/1989 | Ferland | 249/2 |
| 5,015,117 | A | | 5/1991 | Pawlicki | 403/300 |
| 5,074,517 | A | | 12/1991 | Scott | 249/112 |
| 5,154,837 | A | | 10/1992 | Jones | 249/2 |
| 5,261,635 | A | | 11/1993 | Flathau | 249/7 |
| 5,465,542 | A | | 11/1995 | Terry | 52/309.7 |
| 5,608,991 | A | | 3/1997 | Yamashita | 52/2.17 |
| 5,896,714 | A | | 4/1999 | Cymbala et al. | 52/426 |
| 6,010,276 | A | | 1/2000 | Young et al. | 404/8 |
| 6,016,633 | A | | 1/2000 | Elwart | 52/294 |
| 6,021,994 | A | * | 2/2000 | Shartzer, Jr. | 249/6 |
| 6,409,422 | B1 | | 6/2002 | Mittermaier et al. | 404/8 |
| 6,536,737 | B1 | | 3/2003 | Davis | 249/3 |
| 6,629,681 | B1 | | 10/2003 | Miller et al. | 249/3 |
| 6,705,582 | B2 | | 3/2004 | Osborn | 249/6 |
| 6,866,239 | B2 | | 3/2005 | Miller et al. | 249/3 |
| 6,898,915 | B2 | | 5/2005 | Hancock | 52/677 |
| 6,918,567 | B2 | | 7/2005 | Ward et al. | 249/4 |
| 6,931,806 | B2 | | 8/2005 | Olsen | 52/309.11 |
| 6,935,607 | B2 | | 8/2005 | Ward et al. | 249/190 |
| 7,007,436 | B1 | | 3/2006 | Kelley | 52/604 |
| 7,017,316 | B2 | | 3/2006 | DiLorenzo | 52/414 |
| 7,144,530 | B2 | | 12/2006 | Ward et al. | 264/33 |
| 7,152,843 | B2 | | 12/2006 | Ward et al. | 249/216 |
| 7,182,307 | B2 | | 2/2007 | Baker et al. | 249/16 |
| 7,182,309 | B1 | | 2/2007 | Olsen | 249/219.1 |
| 7,255,319 | B2 | | 8/2007 | Albano | 249/34 |
| 7,290,749 | B1 | | 11/2007 | Jessop et al. | 249/34 |
| 7,290,750 | B2 | | 11/2007 | Huber et al. | 52/415 |
| 7,303,361 | B1 | | 12/2007 | Lane | 405/287 |
| 7,331,560 | B2 | | 2/2008 | Jessop et al. | 52/745.09 |
| 8,215,608 | B2 | * | 7/2012 | Oleson | 249/6 |
| 2007/0131840 | A1 | | 6/2007 | Jones et al. | 249/34 |
| 2008/0118308 | A1 | | 5/2008 | Jones | 404/98 |
| 2008/0128581 | A1 | | 6/2008 | Oleson | 249/6 |

* cited by examiner

FIG. 3A
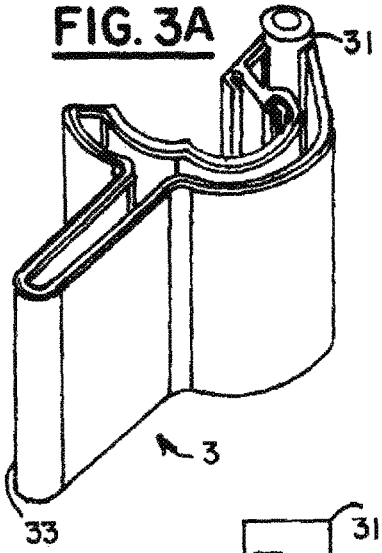
FIG. 3B
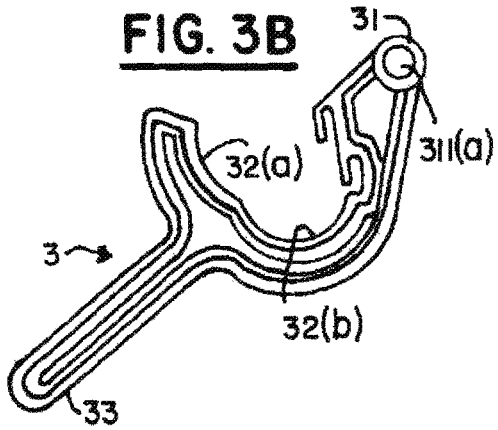
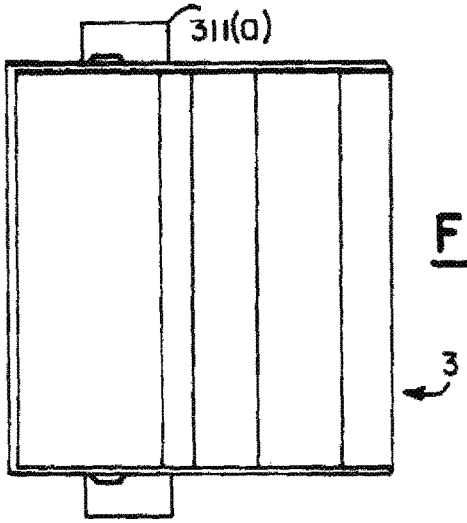
FIG. 3C
FIG. 3D
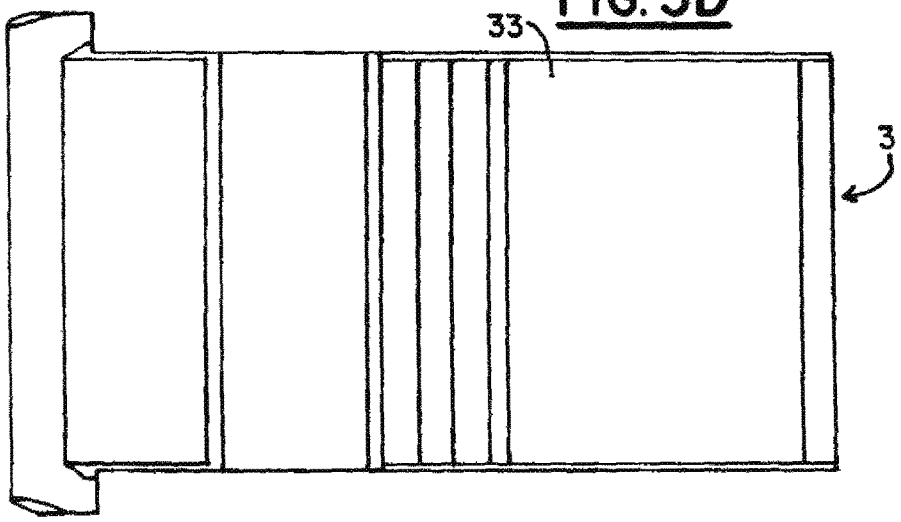

FIG. 10C
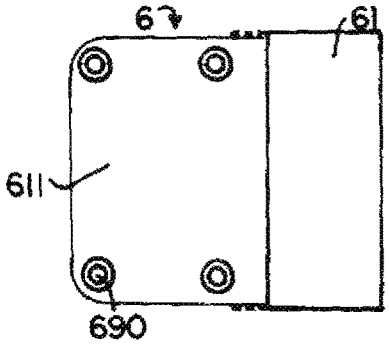
FIG. 10D
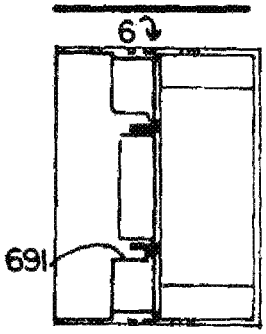
FIG. 10E
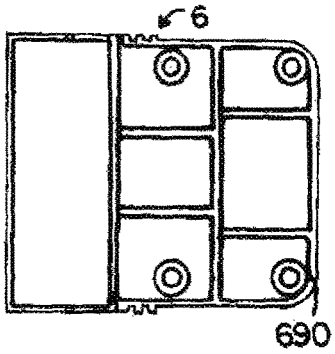
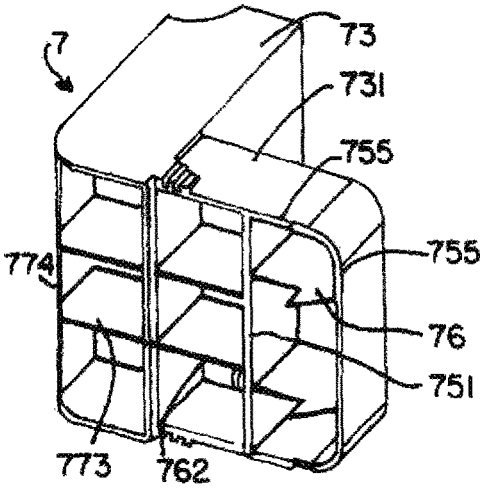
FIG. 11A
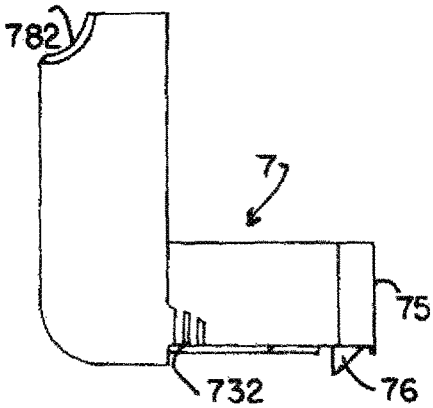
FIG. 11B
FIG. 11C
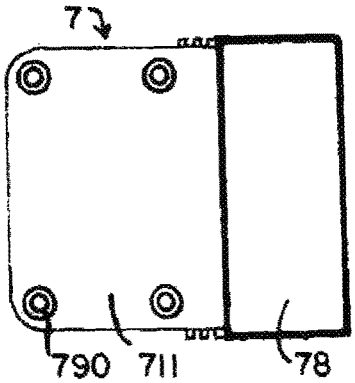
FIG. 11D
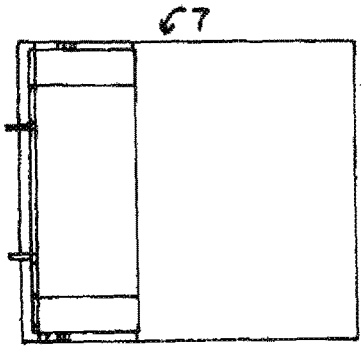

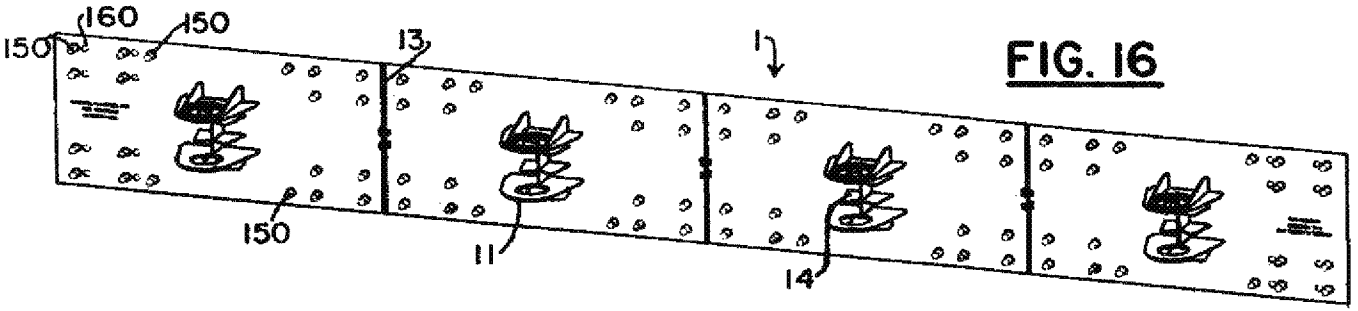
FIG. 16
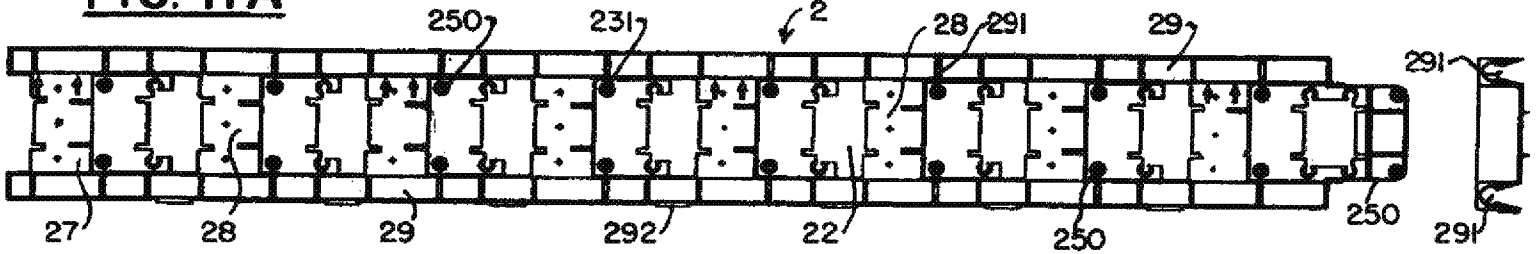
FIG. 17A
FIG. 17B
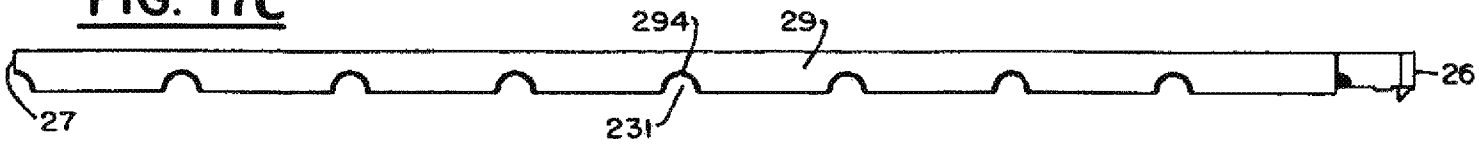
FIG. 17C

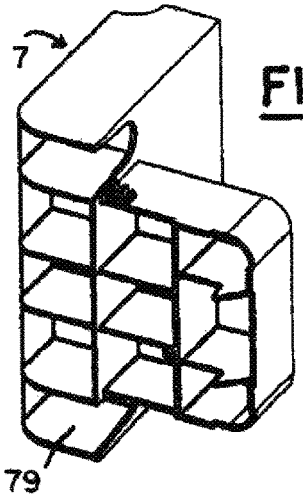
FIG. 21A
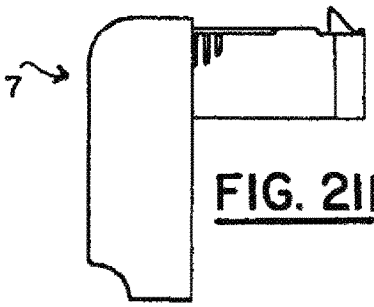
FIG. 21B
FIG. 21C
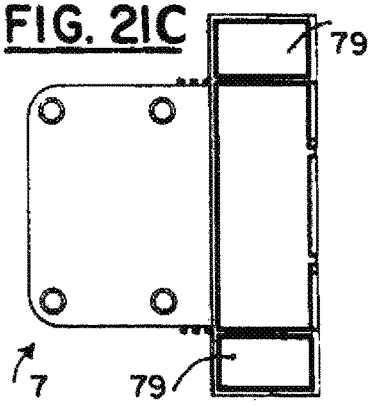
FIG. 21D
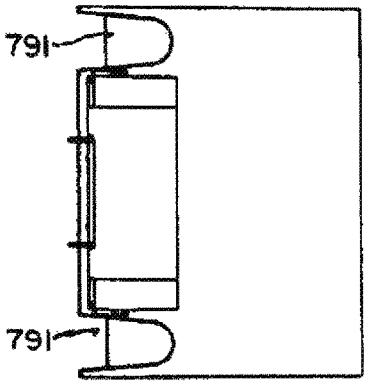
FIG. 21E
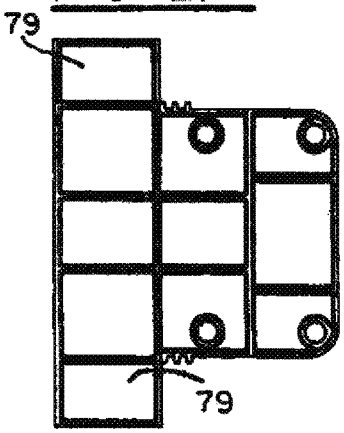
FIG. 21F
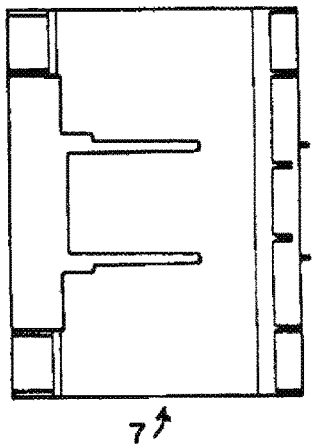

FLEXIBLE, MULTI-CONFIGURATION CONCRETE FORM SYSTEM

PRIORITY INFORMATION

The present invention claims priority as a continuation-in-part application to U.S. Utility patent application Ser. No. 14/489,756, filed on Sep. 18, 2014, which, in turn, claims priority as a continuing application from U.S. Utility patent application Ser. No. 12/661,445, filed on Mar. 16, 2010. The present invention also claims priority to the following three U.S. Provisional Applications:

| | |
|---|---|
| 61/210,564 | Mar. 19, 2009 |
| 61/278,506 | Oct. 6, 2009 |
| 61/339,017 | Feb. 26, 2010 |

and makes reference herein to each in its entirety.

FIELD OF INVENTION

The present invention is generally related to the field of forms for cementitious mixtures, such as concrete, especially forms used for curbs, sidewalks, columns, and the like. In particular, the present invention is directed to a system of flexible reusable plastic forms that can accommodate a wide range of shapes and configurations, using easily-managed connecting and locking arrangements.

BACKGROUND OF THE INVENTION

Forms used in forming concrete and other cementitious mixtures are usually made of rigid, reinforced structures having at least one smooth face (finish surface), if a smooth concrete surface is to result from beneath the form. This is important since many types of concrete structure require smooth finishes.

In general, modern construction requires that a wide variety of different, often unconventional, shapes be used in configuring concrete structures. Very often, there is very little standardization, especially when curved shapes are involved. This means that customized concrete forms must be configured for particular situations.

Traditionally wood has been used for curved concrete forms. This has always been awkward and expensive, requiring skilled carpentry, usually at the construction site. Often, such forms are not reusable. Even if reusable, such forms have always been difficult to clean. More recently, sheet metal has been used, as well as wood, to provide smooth curved surfaces for concrete forms. This material is inexpensive and easy to use in manufacturing processes.

Unfortunately, both wood and metal, when used for the facing of concrete forms, have certain drawbacks. Both wood and metal deteriorate due to a number of reasons pertaining to the characteristics of concrete, and usually necessitate frequent refurbishing or replacement of the forms. Further, sheet metal is especially vulnerable because it is easily deformed in an undesirable manner during installation, transport, or the pressure of the concrete pour.

An assembly of multiple precise, irregular, or complex forms, even for small concrete structures, is often a very expensive and awkward activity. Time is lost on the worksite, and inaccuracies are introduced. Cleaning the forms for reuse is also problematical.

One solution has been the use of plastics. However, both the structural stress and chemical corrosiveness of concrete environments render many plastics unsuitable. Also, even the toughest plastics, such as ABS, can be too flexible for the stresses developed in many concrete pour applications. As a result, even if the plastic can be formed into irregular shapes or curves, adequate support of the plastic form is often lacking in conventional systems. Even when adequate support is found, the overall form system configuration is often inadaptable and hard to use.

Accordingly, there is substantial need for a concrete form system that can accommodate multiple curves, and other irregular or customized shapes. The form system should have sufficient mechanical integrity that it can be combined to support a wide variety of different concrete pour shapes. Likewise, the form system should be easy to assemble and clean, and accommodate easy replacement of damaged parts, especially the smooth surfaces that face the finished concrete pour.

SUMMARY OF THE INVENTION

It is a primary object of the present invention to overcome the drawbacks of existing concrete and cementitious molding systems.

It is another object of the present invention to provide a flexible concrete form system that accommodates a wide range of shapes and sizes, especially curves.

It is an additional object of the present invention to provide a concrete form system in kit form that fully integrates flexible curved forms with rigid straight forms, using only a limited number of component types.

It is a further object of the present invention to provide a flexible concrete form system capable of being used with a wide range of appropriate reinforcements and substrate holders, facilitating a wide range of concrete shapes and applications.

It is an additional object of the present invention to provide a concrete form system in which surfaces normally facing wet concrete can be easily cleaned, without degrading those surfaces.

It is still another object of the present invention to provide a concrete form system in which the forms can be precisely and tightly secured to foundation or substrate holders or connection pieces, such a spikes or rods.

It is yet a further object of the present invention to provide a flexible concrete form system in which minute adjustments can be made to the position of the form using simple mechanisms and processes.

It is again an additional object of the present invention to provide a concrete form system that integrates easily with standard construction materials when placing the forms for a concrete pour.

It is yet a further object of the present invention to provide a flexible concrete form system which can be made of tough, inexpensive materials, in a configuration that distributes external stress without damage.

It is again another object of the present invention to provide a flexible concrete form system in which extensive external clamps are not necessary to ensure form stability for proper concrete forming.

It is still an additional object of the present invention to provide a flexible concrete form system that does not require vulnerable metallic hardware to secure the form for a concrete pour.

It is again a further object of the present invention to provide a concrete form system which maintains a smooth form face, which is not degraded by concrete or other cementitious mixtures.

It is yet another object of the present invention to provide a concrete form system that is easily assembled and disassembled into a contiguous arrangement without destruction to the form system or its parts.

It is yet an additional object of the present invention to provide a flexible concrete form system that can be quickly and easily cleaned, without degrading the material of the form.

It is still another object of the present invention to provide a flexible concrete form system that can be used to create columnar shapes, and can be stacked to create relatively tall concrete structures.

It is still another object of the present invention to provide a concrete form system as a kit in which many different form configurations can be effected by the same parts.

It is again a further object of the present invention to provide a concrete form system which easily admits to easy reinforcement from external structures.

It is yet a further object of the present invention to provide a concrete form system in which multiple right angles can be arranged within limited areas, and without extensive labor.

It is still another object of the present invention to provide a concrete form system that can be quickly and uniformly cut to desired sizes without degrading any of the functionality, or connectivity of the form system.

It is again an additional object of the present invention to provide a concrete from system in which substantial longitudinal extensions of forms can be made without substantial skilled labor, or sacrificing form stability.

It is yet a further object of the present invention to provide a concrete form system which can be applied using only standard sized form parts that can be stacked or otherwise added to each other.

It is still another object of the present invention to provide a concrete form system which can be easily disassembled without any degradation of the forms.

It is yet an additional object of the present invention to provide a concrete form system in which a wide variety of substrate holding and other support devices can be used to hold and reinforce the form system.

It is again a further object of the present invention to provide a concrete form system in which a plurality of different holding or clamping devices can be used to connect the concrete form system to substrate support devices, such as stakes, rods, pipes, and the like.

It is still an additional object of the present invention to provide a concrete form system that does not require extensive amounts of external support structures to support the concrete form configuration.

These and other goals and objects of the present invention are achieved by a multi-piece concrete form system having a flexible faceplate that interacts with at least one rigid support piece, and a first connector system for detachably holding the other two pieces together.

In another embodiment of the present invention a concrete form system uses at least two types of parts to affect a variety of different configurations. The system includes at least one rigid support piece and at least one flexible, curveable faceplate. These two parts are connected together by a contiguous interface wherein the form system is configured to include at least one straight rigid section and at least one curved section for a concrete pour configuration.

In a further embodiment of the present invention a concrete form system comprises at least one flexible, stackable panel. The panel has at least one connection system that provides connection and disconnection to said panel, or to another such panel.

In still another embodiment of the present invention a concrete form system includes two different types of concrete form component. Each of the components comprises a repeating complementary connector pattern at corresponding positions along the length of each of the two components thereby facilitating connection between the two components.

BRIEF DESCRIPTION OF DRAWINGS

FIG. 3A is a top perspective view of one type of substrate support locking device, used as part of the present invention.

FIG. 3B is a top view of the substrate support locking device.

FIG. 3C is a side view of the substrate support locking device.

FIG. 3D is a front view of the substrate support locking device.

FIG. 10C is a front view of the inside corner piece of FIG. 10A.

FIG. 10D is a rear view of the inside corner piece of FIG. 10A.

FIG. 10E is a right side view of the inside corner piece of FIG. 10A.

FIG. 11A is a perspective view of an outside corner piece of the present invention.

FIG. 11B is a top view of the outside corner piece of FIG. 11A.

FIG. 11C is a front view of the outside corner piece of FIG. 11A.

FIG. 11D is a rear view of the outside corner piece of FIG. 11A.

FIG. 16 is a perspective view of a flexible face plate in accordance with an additional embodiment of the present invention.

FIG. 17A is a rear view of a rigid support piece in accordance with a further embodiment of the present invention.

FIG. 17B is a side view of the embodiment of FIG. 17A.

FIG. 17C is a top view of the embodiment of FIG. 17A.

FIG. 21A is a perspective view of an additional embodiment of an outside corner piece.

FIG. 21B is a top view of the outside corner piece of FIG. 21A.

FIG. 21C is a rear view of the outside corner piece of FIG. 21A.

FIG. 21D is a right hand view of the outside corner piece of FIG. 21A.

FIG. 21E is a front view of the outside corner piece of FIG. 21A.

FIG. 21F is a left hand view of the outside corner piece of FIG. 21A.

DETAILED DESCRIPTION OF PREFERRED EMBODIMENTS

Figure 1A:
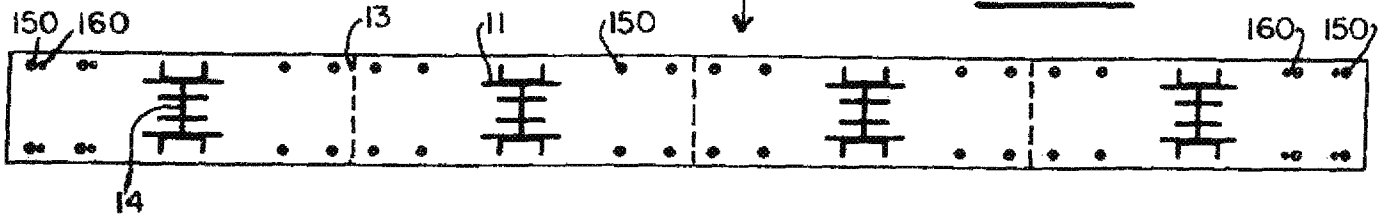
FIG. 1A is a rear view of the flexible faceplate, opposite the side facing of the concrete pour.

The present invention is directed to a concrete form system having multiple types of main components or pieces 1, 2, that can be interfaced with each other in a plurality of different configurations. One component (1) always faces the concrete pour, while the other component 2 provides straight-line support. It is this characteristic that gives the present invention its capability of providing concrete forms for a wide variety of different concrete shapes and structures. The present invention provides a combination of smooth faceplate flexibility (from flexible faceplate 1) with the adequate levels of structural rigidity (from rigid support piece 2) necessary for all concrete forms. The present invention also permits relatively precise adjustments of the forms with respect to anchor points, substrate connectors, and other forms in the system. The present form system can also be used with a wide range of cementitious mixtures and similar materials, such as mortar, asphalt or the like.

A key benefit of the present invention is the ease of connecting the two main components (1, 2), as well as disconnecting them. It is also easy to longitudinally extend the form system due to a unique longitudinal connection/locking system, as will be described infra. Because of the ease of installing the present system, far less labor is expended in the field, even in the creation of curved or very complex concrete form arrangements.

The present system permits the integration of both rigid, straight forms with a variety of curved configurations. The structure of the present invention provides a contiguous, seamless interface between a flexible, curved form arrangement and a straight, rigid form arrangement. This is a capability that has been lacking in the conventional concrete form art. This is accomplished by a number of connection systems (described infra), which distribute external stresses from the concrete pour. Such stresses might otherwise tear the forms apart in conventional systems.

The first component of the novel system is flexible faceplate 1, depicted in FIGS. 1A-1E. Preferably, this structure is made of tough, wear resistant plastic, such as vinyl, ABS, polymers, or other suitable materials, and is sufficiently flexible to accommodate a wide range of curves and other shapes. Virtually any type of suitable flexible material can be used as long as the functionality of the present invention is maintained. This component 1 is always used to face the concrete pour.

Flexible faceplate 1 is constituted by a smooth front face 12, against which a concrete pour is made. This surface must be sufficiently smooth to avoid undue roughening of the final concrete surface which will be exposed once the faceplate 1 is removed. Front face 12, should be of a material sufficiently smooth and resilient that it can be easily cleaned, and the flexible faceplate 1 easily reused for multiple concrete pours.

Like any flexible structure, flexible faceplate 1 requires some structural support to hold it in position during the concrete pouring and curing processes. Also, flexible faceplate 1 must be placed in the correct position on the substrate (such as the ground) for the concrete pour. This is accomplished by conventional substrate holding devices 5, as depicted in FIGS. 7A-7C, and FIG. 9, such as spikes, pipes, rods, rails, or the like.

These substrate holding devices 5 are driven into the substrate (not shown) to a sufficient depth so as to hold the concrete form in the desired position while the concrete is poured, dried, and eventually cured. Such substrate holding devices 5 are generally cylindrical in form, although this is not absolutely necessary. The use of such holding devices is sufficiently well-known in the concrete forming art that there is no need for further elaboration for purposes of understanding the present invention. The present invention is capable of accommodating the majority of commonly-used substrate holding devices, such as spikes, rods, pipes and various support stanchions or, other support structures.

Figure 7A:
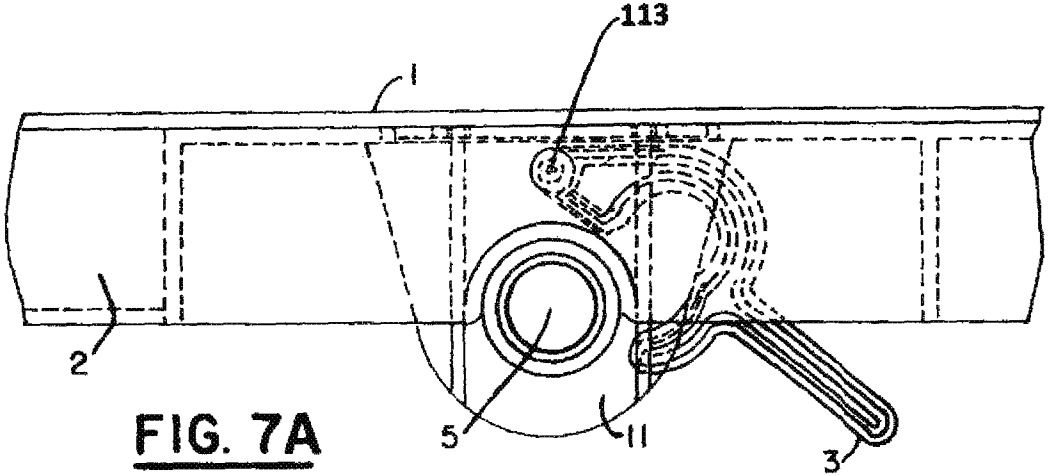
FIG. 7A is a top view depicting one position of the substrate support locking device.
Figure 7B:
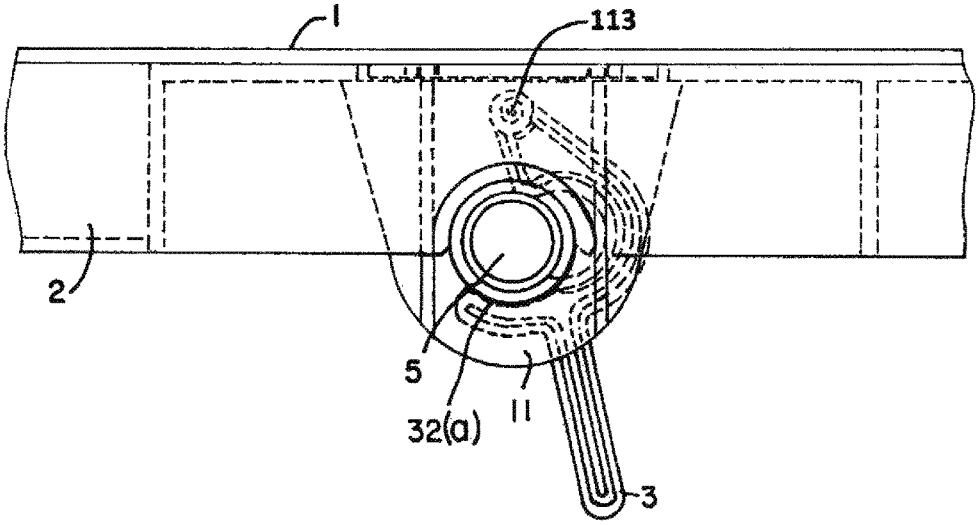
FIG. 7B is a top view depicting the connection of the substrate support locking device and one size of a substrate holding device, such as a stake.
Figure 7C:
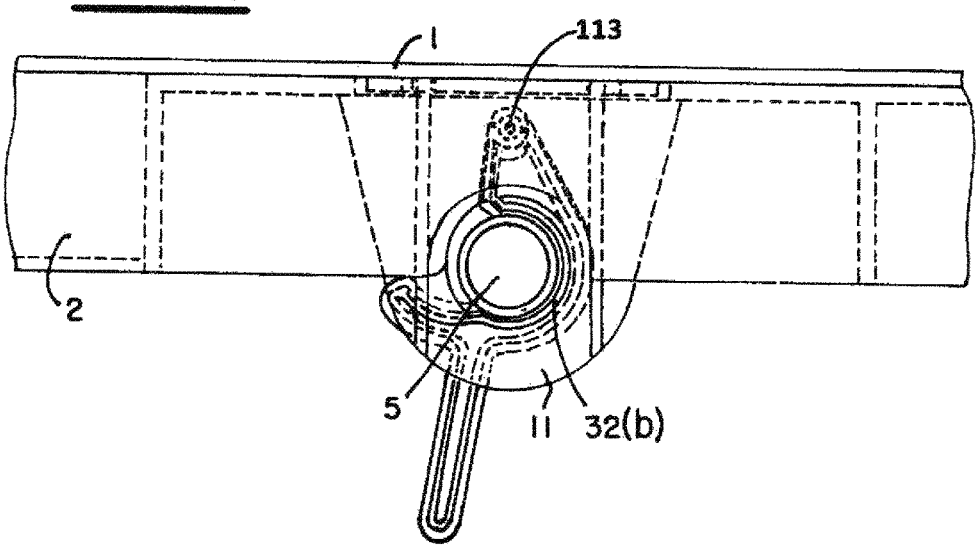
FIG. 7C is a top view depicting the connection of the substrate support locking device and another size of a substrate holding piece, such as a stake.
Figure 9:
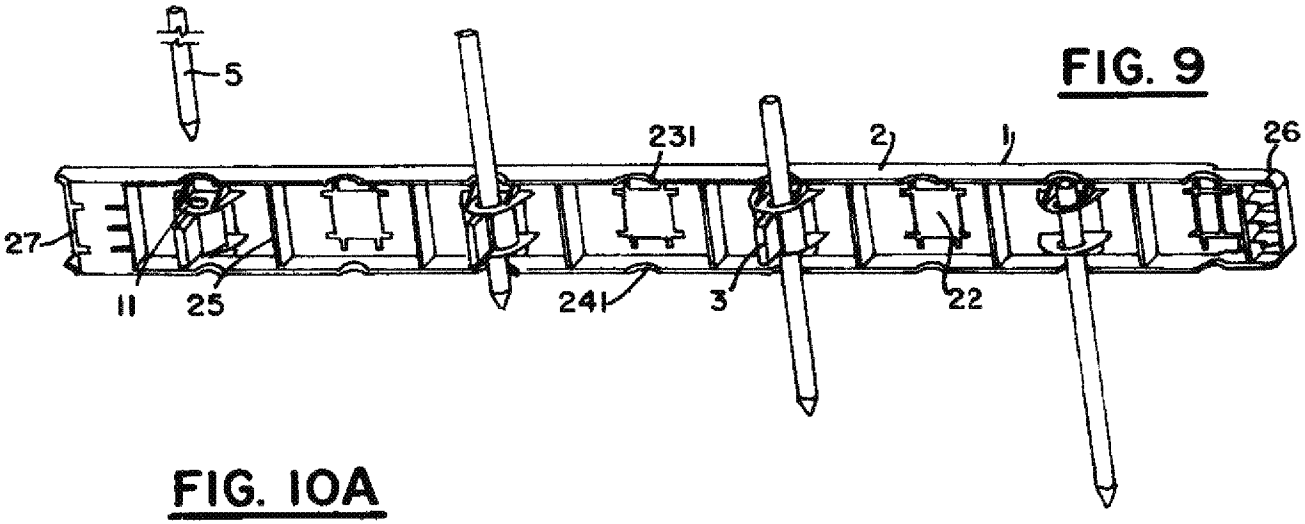
FIG. 9 is a perspective view of one embodiment of the present invention assembled and connected to substrate holding pieces, such as stakes.

To accommodate the substrate holding device 5 (preferably cylindrical spikes), the flexible faceplate 1 contains multiple sets of ring holders 11. In operation, the substrate holding device 5 (as depicted in FIGS. 7A-7C), passes through a set of ring holders 11 (formed as part of flexible faceplate 1, opposite the pour face 12), and into the underlying substrate (usually the ground supporting the future concrete structure). This is depicted in FIG. 9. Spikes or rods 5 need not go through each pair of ring holders 11, and can be placed so that the flexible faceplate 1 can be bent or twisted into any desired shape or curvature.

In the drawings, four sets of ring holders 11 are depicted for a single flexible faceplate 1, having a four foot length. Generally, the flexible faceplates 1 are approximately four feet in length and the ring holders 11 approximately one foot apart, as depicted in the drawings. However, the flexible faceplates 1 may be of any desired length, and the pairs of ring holders 11 may be spaced in any way considered practical or desirable for the final concrete pour.

Figure 19:
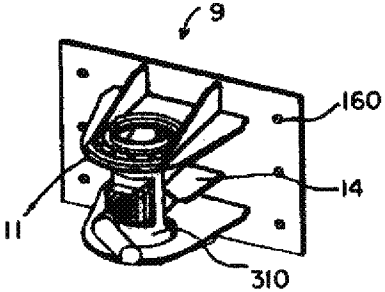
FIG. 19 is a perspective view of a separate connector panel having a substrate support connecting piece.
Figure 20A:
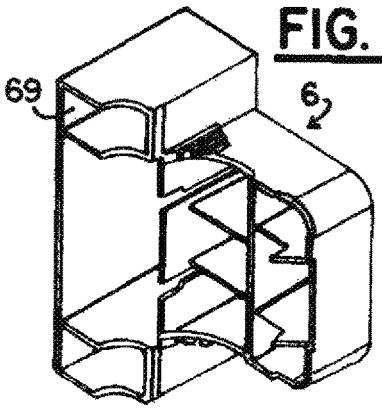
FIG. 20A is a perspective view of a different embodiment of an inside corner piece.
Figure 20B:
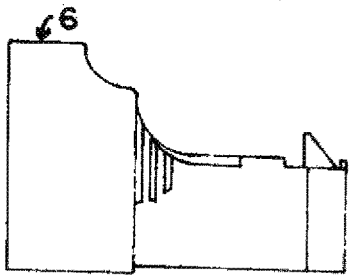
FIG. 20B is a top view of the inside corner piece of FIG. 20A.
Figure 20C:
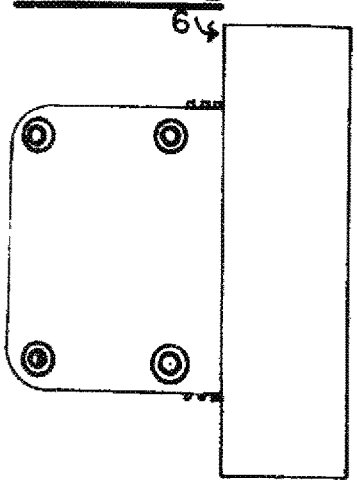
FIG. 20C is a back view of the inside corner piece of FIG. 20A.
Figure 20D:
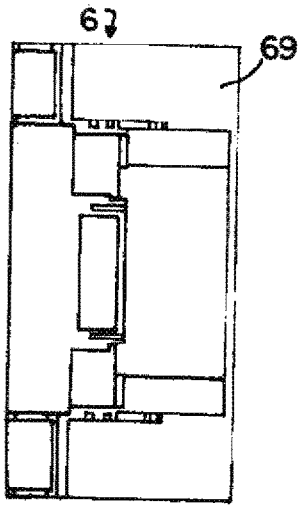
FIG. 20D is a right side view of the inside corner piece of FIG. 20A.
Figure 20E:
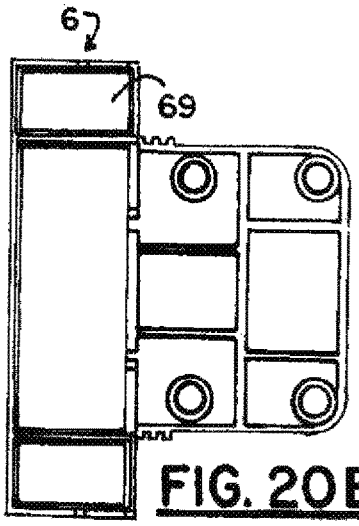
FIG. 20E is a front view of the inside corner piece of FIG. 20A.

Further, additional sets of ring holders 11 can be added to any flexible faceplate 1 by means of individual connector plates 9, depicted in FIG. 19. These connector plates 9 can be jointed to almost any flexible faceplate 1 in almost any desired location through use of the common connection configuration described infra. In this manner, ring holders 11, and the substrate support pieces 5 (such as spikes) that are used with them can be added wherever additional support is needed. This can be crucial for extensive curved configurations described infra.

Each of the ring holders 11 (of flexible faceplate 1) is constituted by a relatively flat main body with a large aperture 112, and a small aperture 113 (when used with the particular substrate support locking device 3, depicted in FIGS. 3A-3D and 7A-7C). The large aperture 112 is used to accommodate the substrate holding device 5, or other elongated structure, while the small aperture 113 is used to accommodate substrate support locking device 3, as depicted in FIGS. 3A-3D and 7A-7C. The relatively flat main body is supported by transverse supports 111. These structures help to support the ring holders 11 and attach them to the main body of faceplate 1. These transverse supports 111, along with edge pieces 114, serve an additional function when faceplate 1 is used in conjunction with support piece 2.

Figure 13:
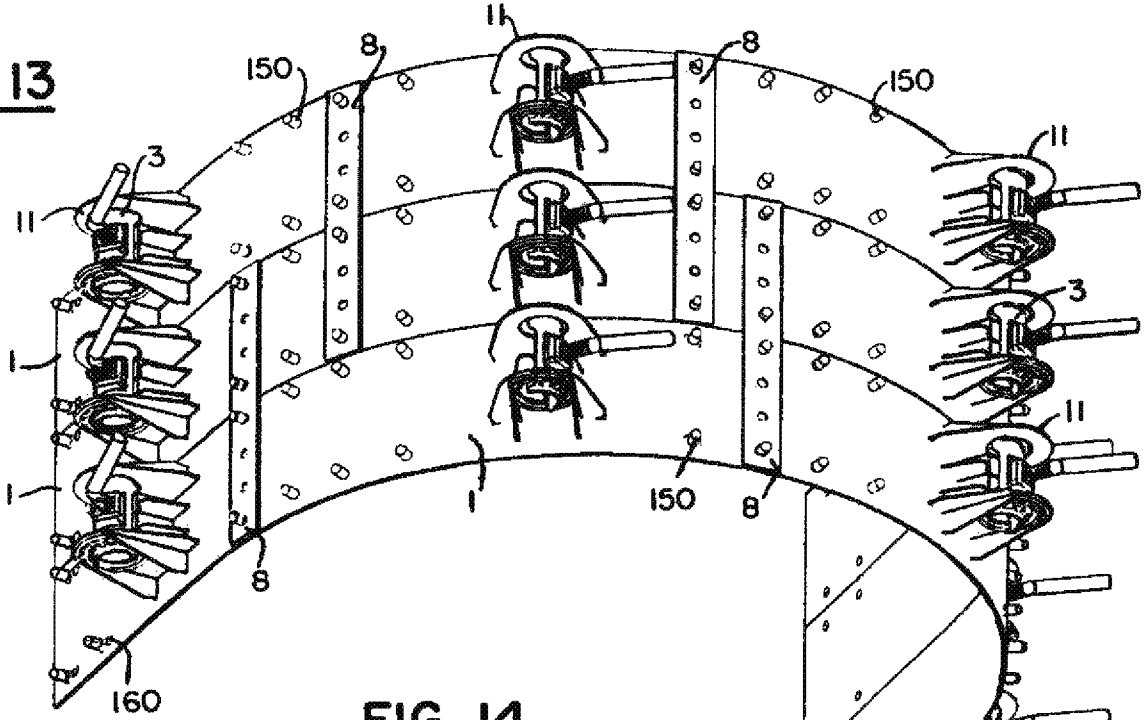
FIG. 13 is a perspective view of an assembly of stacked flexible faceplates in accordance of another embodiment of the present invention.
Figure 14:
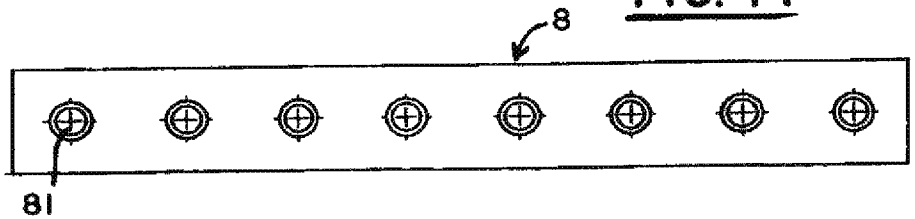
FIG. 14 is a top detailed view of a connecting strip, the use of which is depicted in FIG. 13.

It should be noted that the novel substrate support locking device 3, as depicted in FIGS. 3A-3D and 7A-7C, is merely one example of a substrate support locking device that can be used with the present invention. A wide variety of different locking devices can be used with ring holders 11 of the present invention. Another example is depicted in FIGS. 13 and 19. This variation uses a common screw-type clamping configuration to serve as a locking device 3. With this variation, aperture 113 in ring holder 11 is not required. A wide variety of such substrate support locking devices, are known in the conventional art, and can be substituted for the novel arrangement of FIGS. 3A-3D and 7A-7C.

Many concrete applications require form systems that can provide a rigid, straight line or a series of multiple straight lines. Very often, the substrate holding devices 5, even if placed one foot apart, are insufficient to hold a form piece such as flexible faceplate 1 in an unwavering straight line. In some situations, a sufficient number of substrate holding devices 5, or good anchoring points in the substrate, are not available, or cannot be properly used so that a flexible piece such as faceplate 1 cannot achieve the strict rigidity necessary for certain concrete pours. Consequently, additional rigid, structural means are necessary to provide sufficient rigidity for sections of flexible form structures, such as flexible faceplate 1.

Figure 2A:
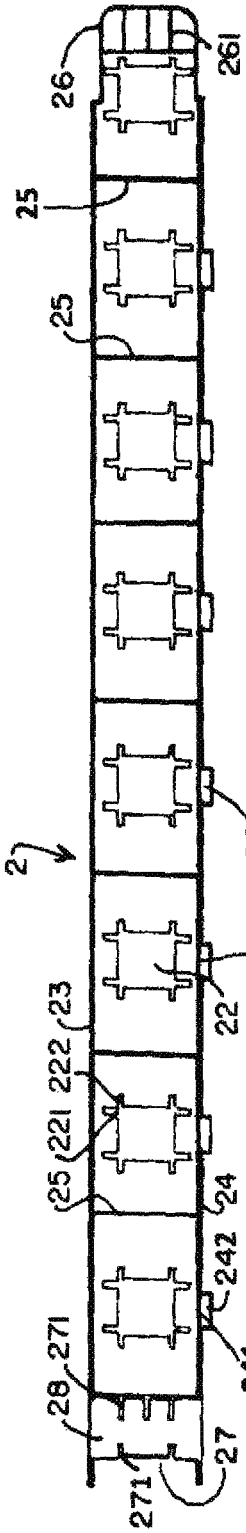
FIG. 2A is a rear view of a rigid support piece, opposite the side interfacing with the flexible faceplate.
Figure 2B:
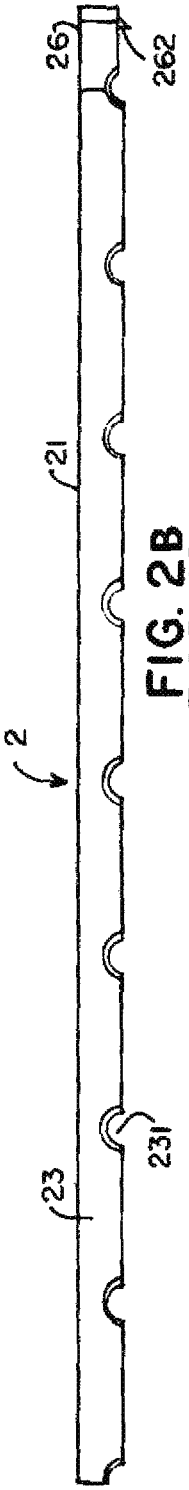
FIG. 2B is a top view of the rigid support piece.
Figure 4:
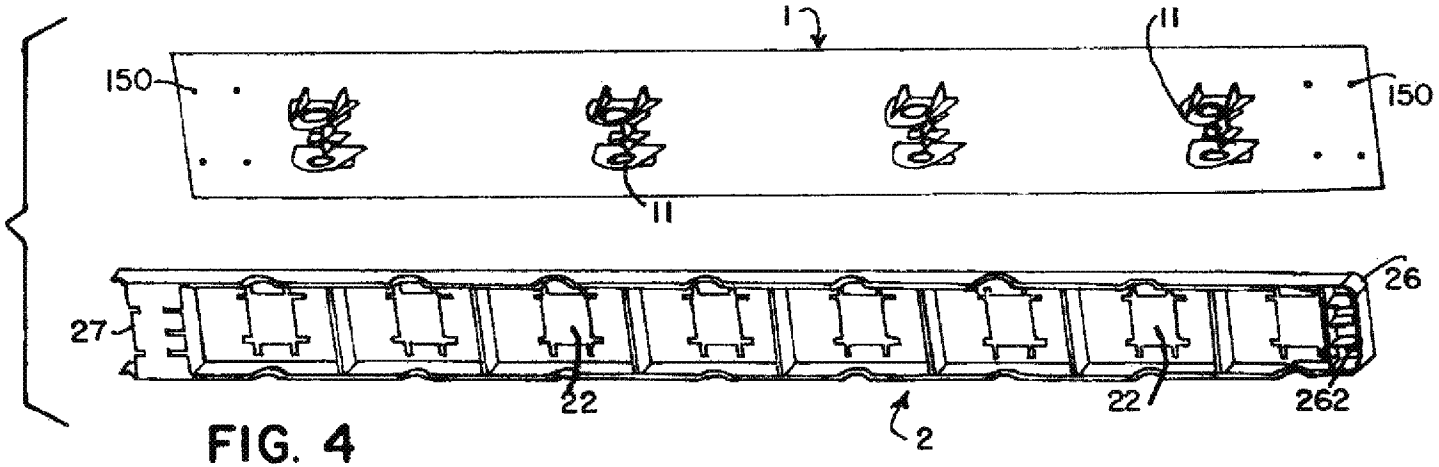
FIG. 4 is a perspective view depicting the relationship between the flexible faceplate and the rigid support piece.
Figure 5:
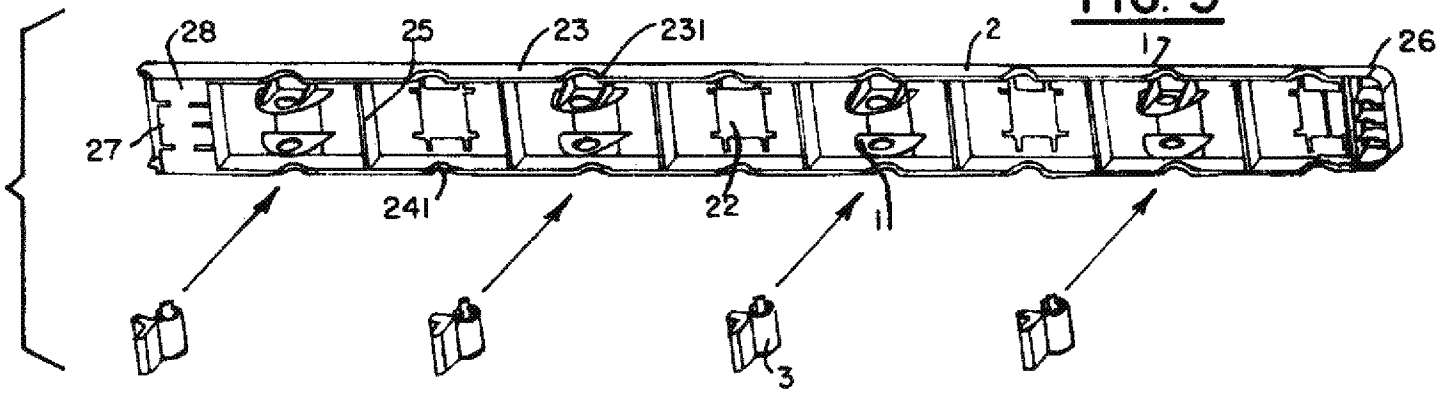
FIG. 5 is a perspective view depicting the relationship between the connected flexible faceplate/rigid support piece combination and substrate support connecting pieces.
Figure 6:
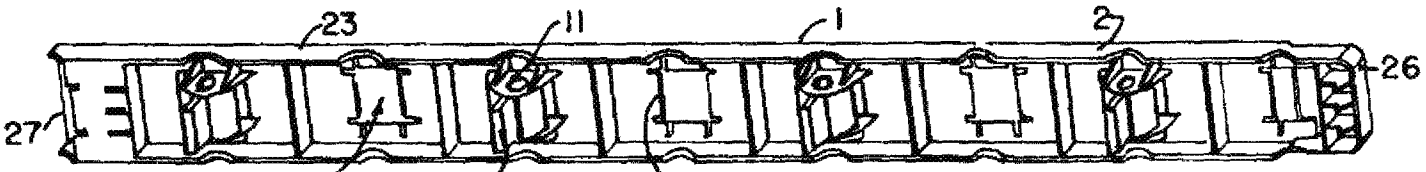
FIG. 6 is a perspective view depicting all three pieces of FIG. 5 operationally connected together.

The present invention provides such a structure in the form of rigid support piece 2, as depicted in FIGS. 2A, 2B and 2C. Rigid support piece 2 has a front face 21 against which the rear of flexible faceplate 1 is positioned. Rigid support piece 2 also has an upper longitudinal wall 23 and a lower longitudinal wall 24, both at the periphery of front face 28. Further rigidity and support of the overall structure of rigid support piece 2 is provided by transverse walls 25, located at approximately half foot intervals along the length (preferably four feet, for example) of the rigid support piece 2. The result is a rigid structure capable of maintaining a long straight line against the weight of poured concrete along its entire length.

Part of the strength of the present system is achieved by the interconnection of the flexible faceplate 1 with rigid support piece 2, using ring holders 11 extending through major apertures 22 of rigid support piece 2. When a substrate holding device 5 is placed through ring holders 11, the combined structure of flexible faceplate 1 and rigid support piece 2 is securely held together, and held to the substrate (or ground) upon which the concrete structure will rest.

The presence of substrate holding device 5, while helpful, and sometimes sufficient for proper connectivity and support, is not the only feature providing strength and stability for the present concrete form system (combination of flexible faceplate 1 and rigid support piece 2). One of the key advantages of the present invention is the easy connectivity (and capability for easy disconnection) between flexible faceplate 1 and rigid support piece 2.

Secure connectivity and a contiguous interface between these two major components 1, 2 of the present system is provided by multiple connection systems having multiple structural elements, arranged in repeating complementary patterns.

Part of one connection system for the connection between flexible faceplate 1 and rigid support piece 2 is provided by slots 222 and 221 formed at the corners of major aperture 22. These slots are sized and located to provide a secure friction fit for transverse supports 111 and edge pieces 114, respectively. While the connection of ring holder 11 and major aperture 22 need not be a true pressure fit or friction fit, the structure of the two sets of perpendicular slots 221, 222 and the transverse supports 111 and edge pieces 114 interacting with them provide substantial, structural integrity through the use of multiple contact points distributing the stresses on the overall combined structures, (components 1 & 2). Multiple connections of this type greatly facilitate a firm (yet easily removable) connection between faceplate 1 and support piece 2.

Multiple sets of ring holders 11 provide a very secure, but essentially reversible connection between faceplate 1 and support piece 2 along the respective lengths of these two structures. While the aforementioned connectivity with transverse supports 11, edge pieces 114, and slots 222 and 221 are very helpful in maintaining a secure connection (through multiple contact points distributing stress) between the two major components (1, 2) of the present system, they are not the only connective features between flexible faceplate 1 and rigid support piece 2. Other, more crucial connecting structures are described infra.

Another level of connectivity between flexible faceplate 1 and rigid support piece 2 resides in another connection system, including a series of repeating, complementary connection prongs 150 (on flexible faceplate 1) and receiving apertures 250 on rigid support piece 2. In one preferred embodiment, the connecting prongs 150 are approximately ½ inch in length and ¼ inch thick. Receiving apertures 250 on rigid support piece 2 are sized so as to provide a friction-fit or press fit when receiving complementary connecting prongs 150. Because the material of both the flexible faceplate 1 and rigid support piece 2 are preferably a high strength plastic, such as ABS or a polymer, the press fit provided by connecting prongs 150 and receiving apertures 250, provides a high level of security when the press fit is made. The substantial number of connecting prongs 150 and receiving apertures 250 along the common span of faceplate 1 and rigid support piece 2 distribute external stresses that might otherwise tear the two components (1,2) apart.

FIG. 1A depicts an additional variation to the four prong connector pattern on the flexible faceplate 1. At both ends of the flexible faceplate 1, the four connection prongs 150 are accompanied on face plate 1 by four apertures 160. The use of these apertures facilitates connecting flexible faceplate 1 end to end (longitudinally) without the use of a rigid support piece 2 as is done in FIG. 15. It should be noted that in another variation or embodiment, wherein the spacing of all of the connecting prongs 150 are equal, then a perpendicular connection between two flexible faceplates 1 can be facilitated.

The same complementary pattern (and spacing) of connection prongs 150 and receiving apertures 250 are repeated at regular intervals along the length of both the flexible plate 1 and rigid support piece 2. This is a crucial aspect to forming the stable, contiguous interface between the major components 1,2 to withstand external stresses.

Figure 1B:
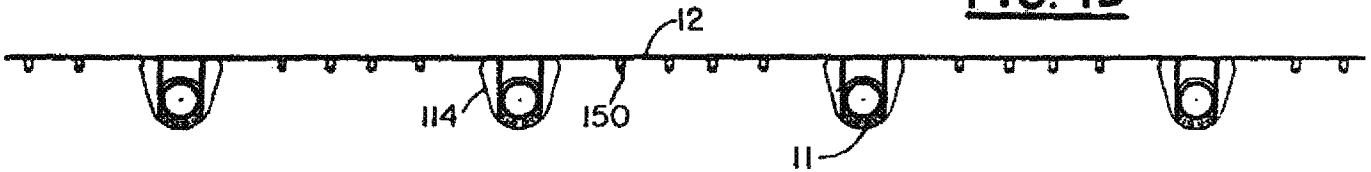
FIG. 1B is a top view of the flexible faceplate.
Figure 1C:
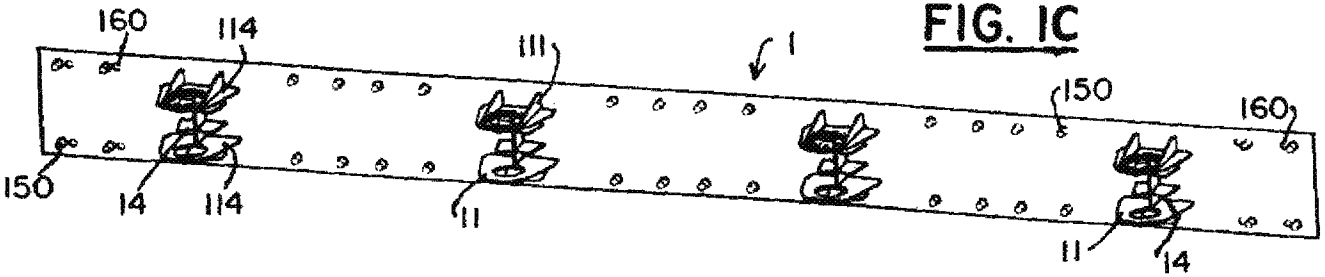
FIG. 1C is a perspective view of the flexible faceplate.

The most basic embodiment of the connector configuration is found in FIG. 1C. A more complex variation is found in FIG. 1A, with the addition of receiving apertures 160 on flexible faceplate 1. A more complex configuration is depicted in the embodiment of FIG. 16, in which an additional connecting prong 150 is added to each set of four. It should be understood that almost any configuration of connecting prongs 150 (and their complementary receiving apertures 250) can be used as long as the pattern (and spacings) repeat themselves periodically along the length of the relevant pieces.

In another preferred embodiment, the flexible faceplate 1 is segmented, usually with cut lines 13 (as depicted in FIG. 16), so that each set of ring holders 11 has at least one set of connecting prongs 150 on each side of it. As depicted in FIG. 1A, each set of ring holders 11 has two sets (of four) connecting prongs 150 between them. Cut lines 13 divide the flexible faceplate 1 into segments so as to effect one set (of four) of connecting prongs 150 on each segment. This arrangement provides the most flexibility for moving and configuring pieces of the flexible faceplate 1 at various points along rigid support piece 2, or as described infra various arrangements of the flexible faceplate 1 by themselves.

An additional alternative is disclosed in FIG. 1A, wherein some of the connecting prongs 150 are provided with receiving apertures 160 alongside. These receiving apertures 160 are spaced in exactly the same manner as the connecting prongs 150, but are slightly offset therefrom so as to provide room for receiving other connecting prongs 150, either from the same flexible faceplate 1, or other flexible faceplates 1. In this manner, the flexible faceplates 1 can be easily connected to each other so that they are easily extended, even without the benefit of the rigid support piece 2.

While FIG. 1A depicts receiving apertures 160 as being only at the two end sets of connecting prongs 150, the present invention is not necessarily limited thereby. Rather, receiving apertures 160 can be placed at any point along the length of the flexible faceplate. Preferably, this is done with the same spacing and configuration as connecting prongs 150, so as to repeat the same pattern. Besides extending the length to which flexible faceplate 1 can be extended, there is also the capability of additional types of configuration. For example, multiple extensions can be connected to the same flexible faceplate 1, using a number of additional receiving aperture 160 arrangements along the length of the flexible faceplate 1.

Because of the repetition of the pattern of connecting prongs 150 and receiving apertures (250, 160) on both the flexible faceplate 1 and rigid support device 2, respectively a wide variety of different form configurations are easily achieved using the present invention. The use of the repeating pattern facilitates the adaptability of the system to a wide variety of shapes, while using standard kit components. Because of the repeatability of the various connection systems, both components (1,2) can be cut into small segments while still maintaining connecting capability.

The flexible faceplate 1 configuration depicted in FIG. 1A has dimensions selected for both ease of manufacturing, and standardization for construction sites. This embodiment is approximately ⅛" thick and four inches in width and is manufactured in four foot lengths with three cut lines so that the four foot length can be divided into one foot segments. However, flexible faceplate 1 can be cut into different lengths to facilitate assembly of any desired concrete form assembly.

Further, while the pattern of ½ inch connecting prongs 150 in the first preferred embodiment has been established to have a spacing of three inches separation in the lateral direction and 1¾ inches separation in the longitudinal direction, the present invention is not limited thereby. Rather, the present invention merely requires that the same aperture/connecting prong configuration be maintained throughout so that multiple connections can be made at multiple points along both the flexible faceplate 1 and the rigid support piece 2. Likewise, the size of the connecting prongs and apertures can also change within the concept of the present invention. The current spacing and configuration has simply been chosen for ease of manufacturing and standardization on construction sites.

While the width of the first embodiment of the flexible faceplate 1 is four inches, the present invention is not necessarily limited thereto. Rather, another embodiment having a six inch width is discussed infra. The six inch wide arrangement while depicted in drawings and described in further detail, is not the only dimension available for the present invention. The present invention can encompass virtually any width and length of flexible faceplate 1 that can be manufactured. At the very least, it is necessary only that there always be a repeating pattern for the complementary connecting system so that the two components 1, 2 can easily be connected to each other, and disconnected once it is time to remove the form from the set concrete.

In many situations, where the flexible faceplates 1 require the use of rigid support pieces 2, the interconnection between rigid support pieces 2 obtains increased significance, as does the interconnection between flexible faceplates 1 and rigid support pieces 2. Accordingly, multiple distributed connections are a key part of the present inventive system.

Figure 22:
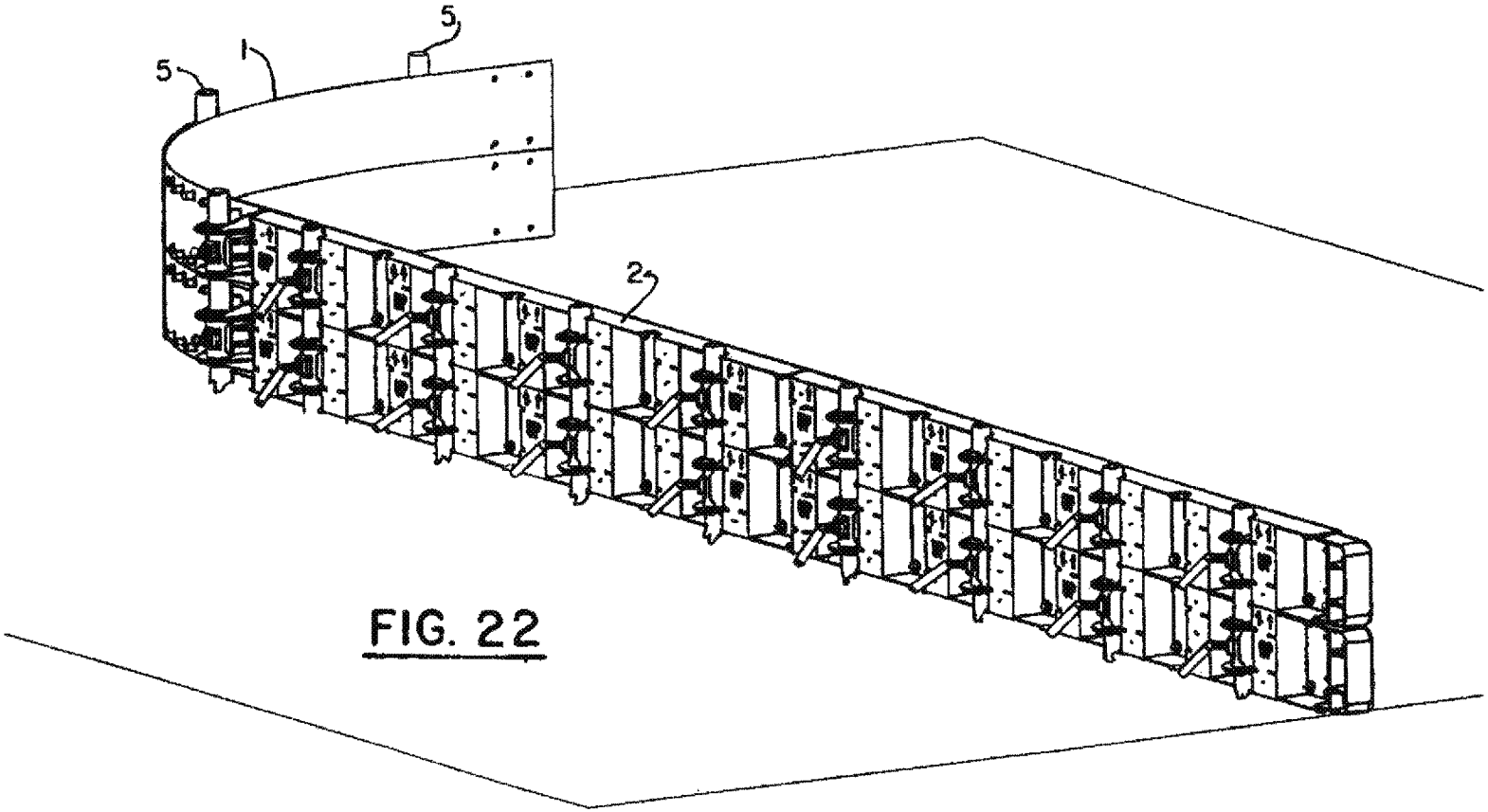
FIG. 22 is a perspective view depicting the interface between stacked straight, rigid concrete forms and flexible curved forms.

Because the major apertures 22 are preferably placed approximately six inches apart along the length (for example four feet) of the rigid support piece 2, flexible faceplate 1 and rigid support piece 2 can be offset from each other, permitting overlapping of these respective pieces 1, 2. As a result, a wide variety of arrangements can be achieved using multiple overlapping flexible faceplates 1 for a single support piece 2. Likewise, multiple rigid support pieces 2 can be used for a single flexible faceplate 1 to help facilitate support of that faceplate in a variety of different angles, curves, or combined configurations. One example is depicted in FIG. 22.

It should also be noted that various lengths of both faceplate 1 and support piece 2 are easily accomplished by two repeating complementary connection systems and can also be employed to facilitate a particular configuration for a concrete pour. Because both flexible faceplate 1 and rigid support piece 2 are made of a resilient plastic such as ABS or various polymers, they can be modified in the field with appropriate cutting tools. To facilitate cutting of both the flexible faceplate 1 and rigid support piece 2, cut lines 13 are preferably provided at appropriate lengths along each of the subject components (1, 2). For example, such cut lines 13 are depicted in FIG. 16.

The aforementioned dimensions are provided as examples. However, these values can be used for purposes of standardized construction assembly, and factory mass production of the subject concrete form pieces. Different arrangements of ring holders 11 and different lengths of flexible faceplate 1 and rigid support piece 2 can be provided on a special order basis from a plastic manufacturing facility.

As an alternative to manufacturing varying lengths of flexible faceplate 1 and rigid support piece 2, these pieces can be cut, or extended in the field. Extension of flexible faceplates 1 is facilitated by the previously-described connections between faceplate 1 and multiple rigid support pieces 2, as well as the use of substrate support devices 5 at various points along the length of the overall form structure. Examples are depicted in FIGS. 9 and 22. Lengthening of the overall form structure can also be accomplished by additional flexible support pieces 2 connected to each other.

The longitudinal connection between rigid support pieces 2 is facilitated by means of protruding or male longitudinal locking piece 26 and receiving or female longitudinal locking piece 27. Each rigid support piece 2 has one of each. The protruding longitudinal locking piece 26 is characterized by a plurality (two FIG. 8E) of thin ribs 261 with preferably sawtooth prongs 261. These prongs interact with receiving slots 271 of the receiving longitudinal locking piece 27.

In normal operation, rigid support pieces 2 are longitudinally connected to each other using the interactive connection of longitudinal locking mechanisms 26, 27. Upper and lower ribs 261 each have preferably sawtooth prongs 262, which interact by a friction fit with upper and lower holding slots 271, and the sleeve-like receiving longitudinal locking pieces 27. Two locked rigid support pieces 2 can be released, by simply flexing the two pieces to release the sawtooth prongs 262, and pulling the two rigid support pieces 2 apart.

By connecting rigid support pieces 2 longitudinally to each other, virtually any length of straight concrete form can be developed using the system of the present invention. Further, the longitudinal locking mechanisms 26, 27 can be preserved even if rigid support piece 2 is shortened, simply by cutting sections out of the middle of the rigid support piece 2. The adjacent support pieces 2 can then held together at the cut sections using an overlapping faceplate 1. Other adjusting arrangements are also available, as described infra.

The receiving longitudinal locking pieces have holding slots 271 on the opposite or rear wall 28 (to the front face 21) to receive the sawtooth prongs 262 on the protruding longitudinal connector 26. The slots 271 have widened upper sections along part of their length in order to better receive the sawtooth prongs 262 before the protruding longitudinal locking pieces 26 are moved all the way into the receiving longitudinal locking piece 27. At which point, the holding slots 271 have thinned so that a sturdy friction grip is maintained on the sawtooth prongs 262.

The receiving longitudinal locking piece 27 has upper and lower semi-circular indents 272 on both extended longitudinal walls. These indents fit around upper and lower flat ribs 264 on the protruding longitudinal locking pieces 26. This fit on upper and lower walls 23 and 24 keeps the two rigid support pieces 2 from rotating with respect to each other by distributing pressure from the concrete pour applied perpendicularly to the faces of flexible faceplates connected to the rigid support pieces 2.

Further structural support can be found for the inventive system by using readily available construction materials commonly found on construction site. For example, the present invention is sized and configured so that a section of conventional 2"×4" lumber fits between the upper and lower longitudinal walls 23, 24, and between transverse walls 25. In this manner, sections of 2"×4" can be used to extend a particular support piece 2 in either direction as needed. If further stiffening of a particular support piece 2 is required, appropriate sized blocks of 2"×4" lumber can be placed in those sections of support piece 2 in which ring holders 11 are not positioned. Selected ring holders 11 can also be cut off where appropriate, as can latitudinal walls 25 to accommodate greater lengths of 2"×4" lumber.

The present invention is not confined to only longitudinal extensions. Rather, the system of the present invention facilitates stacking of the rigid support pieces 2, as depicted in FIG. 22. Stacking can be accomplished by substrate holding devices 5 passing through the ring holders 11 of a vertical stack of rigid support pieces 2 combined with flexible faceplates 1. The interconnecting mechanism holding a vertical stack of rigid support pieces 2 together need not be a substrate holding device which extends into the underlying ground or substrate. Rather, interconnecting rods (or other connecting structures) can be used only to hold a vertical stack together while substrate holding devices 5 are used on other parts of the system.

Stacking is further facilitated through the use of upper annular indents 231, and lower annular indents 241, located respectively on the upper longitudinal wall 23 and lower longitudinal wall 24. Interlocking to prevent longitudinal or horizontal shifting is provided by locking lip 242 on the lower longitudinal wall 24 of each of the rigid support pieces 2. Locking lip 242 interfaces with annual indent 231 on a lower rigid support piece 2 to help supplement the locking provided by the substrate holding device 5, or a connecting rod through multiple vertical sets of ring holders 11, as depicted in FIG. 22.

The upper and lower annular indents, 231, 241 and the locking lips 242 serve an additional purpose, further strengthening rigid support piece 2. The structures add additional rigidity, and can be crucial since the cut lines on rigid support piece 2 are placed in the middle of the annular indents 231, 241. The annular indents interfacing with the locking lips 242 provide support at the cut lines, which can be especially important once a cut has been made, and the shorter section of the rigid support piece 2 must support itself, as well as concrete pour to which it will be subjected. It should be noted that the annular indents, 231, 241, and locking lips 242 are an integral part of the support structure of the rigid support piece 2 to facilitate stacking.

Also serving to provide a secure support structure, which distributes external stress, is the overall structure of the rigid support piece 2, including the longitudinal walls 23, 24, transverse walls 25, and the various connection points to any associated flexible faceplate 1. It is important to note that throughout the present invention, multiple connection points are used to distribute the stresses over the widest possible range of the combined structure (1, 2).

The secure, contiguous interface between the flexible faceplate 1 and the rigid support piece 2 facilitates a stable transition from a rigid straight structure to a flexible, curved structure. An example of this is depicted in FIG. 22, in which both a rigid straight line form and a flexible curved form merge seamlessly into each other. This capability is the result of the overall connection systems between the flexible faceplate 1 and the rigid support piece 2, as discussed supra.

In one embodiment, tight, precise interlocking of vertically stacked support pieces 2 is effected by means of a substrate support locking device 3, as depicted in FIGS. 3A-3D. Substrate support locking device 3 is sized so that it fits between the ring holders 11 of a set of ring holders, as depicted in the drawings. Pivot 31 of locking device 3 is held to the ring holders 11 by means of extensions 311(*a*), 311(*b*) extending into small apertures 113 on each ring holder of a pair of ring holders 11. These extensions 311(*a*), 311(*b*) facilitate the use of locking device 3 to pivot about the axis of pivot 31. This provides leverage for the substrate support locking device 3 to grip to the external substrate holding device 5 while also holding faceplate 1 to support piece 2. The use of the pivot 31 facilitates leverage by means of handle 33 so that a tight friction fit between either of annular receivers 32(*a*), 32(*b*) with the substrate holding device 5 can be accomplished. The annular shape of substrate support locking device 3 permits a certain amount of flexing to help facilitate a pressure fit of substrate support locking device 3 with substrate holding device 5. Preferably, the substrate holding device 5 is cylindrical to affect a much tighter fit than would be possible with a non-cylindrical shape. Annular receivers 32(*a*), 32(*b*) are of two different sizes to accommodate two sizes of substrate holding devices 5.

As depicted in FIGS. 7A-7C, substrate support locking device 3 rotates on pivot 31 so that force can be exerted to effect a friction fit between locking device 3 and substrate holding device 5. Two sizes of annular substrate holding device 5 can be accommodated, as depicted in FIGS. 7B, 7C. Preferably, the two sizes of substrate holding device 5 are ⅞" in diameter and ¾" in diameter. The length of handle 33 provides the leverage necessary to make and break the friction connection between either of the annular receivers 32(*a*), 32(*b*), and the substrate holding device 5. The tight fit resulting therefrom allows the combined structure to be moved vertically along the substrate holding device 5, or interconnecting rods through the sets of ring holders 11 of vertically adjacent faceplates 1. As a result, the vertical adjustment of the overall form structure can be very precise and very secure. Further, the concrete form system of the present invention does not have to be uniform in the vertical direction. This means that the concrete form system of the present invention can accommodate a wide variety of different concrete structures.

It should be noted that while the drawings depict ring holders 11 extending through every other aperture 22, this configuration is not necessary to the operation of the present invention. Rather, ring holders 11 can be placed in every aperture 22, or in fewer apertures 22 than are depicted in the drawings.

Figure 12:
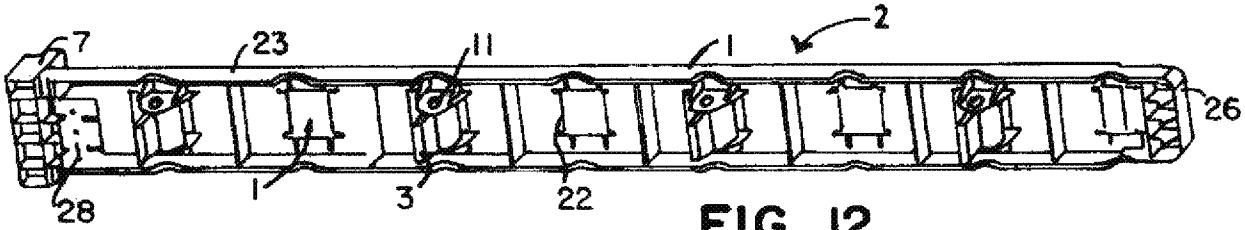
FIG. 12 is a perspective view of an assembly including both inside and outside corner pieces of the present invention.

Because a wide variety of different sizes are used for concrete forms on construction sites, flexibility in the size and the configuration of the forms is essential. To best facilitate this, easy longitudinal connections can be made for virtually any length of rigid support piece 2. Further, rigid support piece 2 must facilitate cutting at almost any length to accommodate specific concrete designs. Another advantage lies in the capability of arranging rigid support pieces 2 at various angles to each other, as depicted in FIG. 12.

One advantage of the present invention is that rigid support structure 2 can be cut as desired to create the desired support for a particular configuration of concrete form. However, the cutting operation will eliminate one or even both the longitudinal locking pieces 26, 27. This removal renders the attachment of adjacent support structures 2 far less convenient, often necessitating extemporaneous mechanical modifications in the field (often a very bad strategy on construction sites).

Figures 8A, 8B, 8C, 8D:
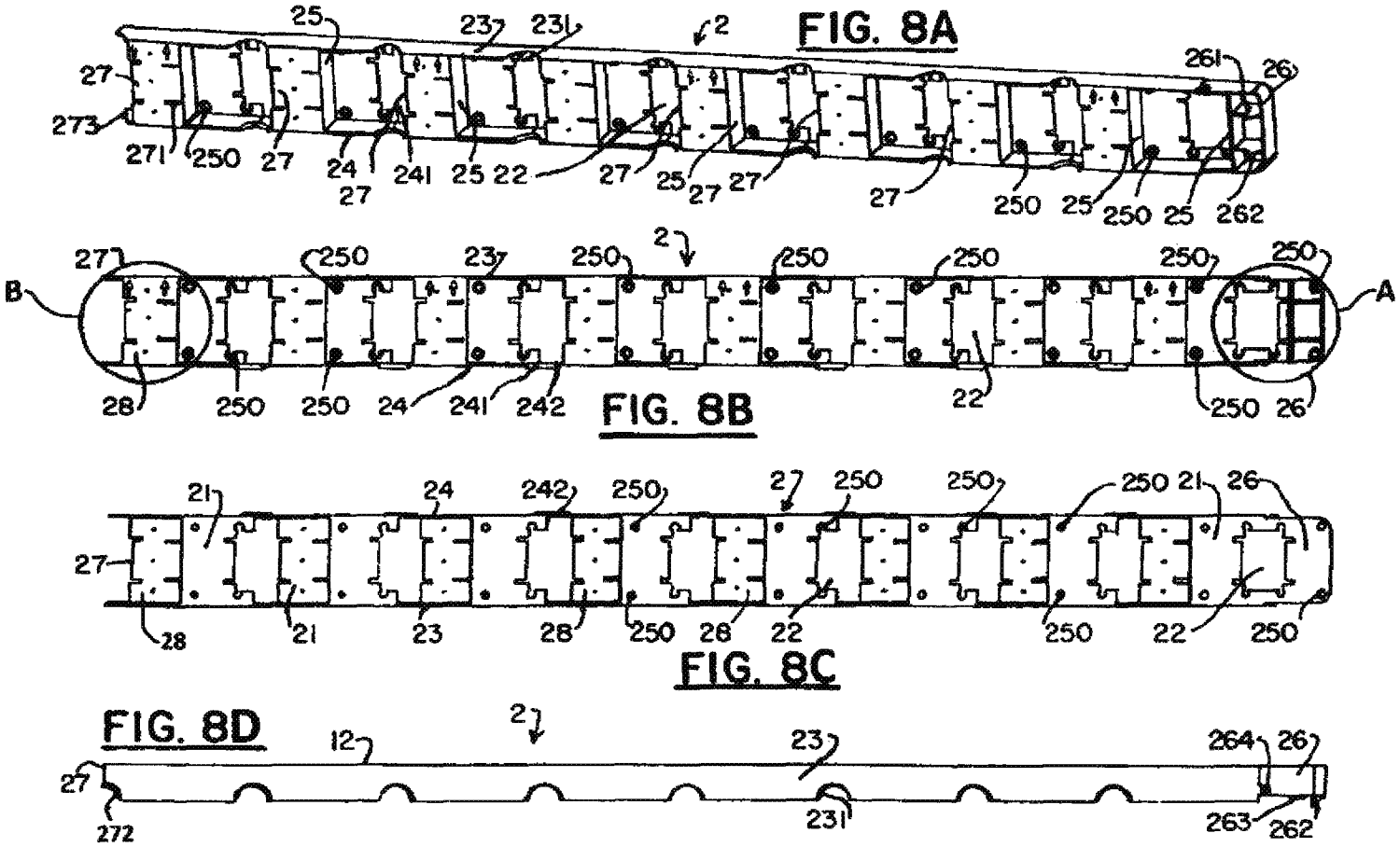
FIG. 8A is a perspective view of another embodiment of the rigid support piece of the present invention.
FIG. 8B is rear view of the rigid support piece of FIG. 8A, identifying two detailed portions A,B.
FIG. 8C is a front view of the rigid support piece of FIGS. 8A and 8B as rotated about its longitudinal axis, with the bottom side up.
FIG. 8D is a top view of the rigid support piece of FIGS. 8A, 8B, and 8C.
Figures 8E, 8F, 8G:
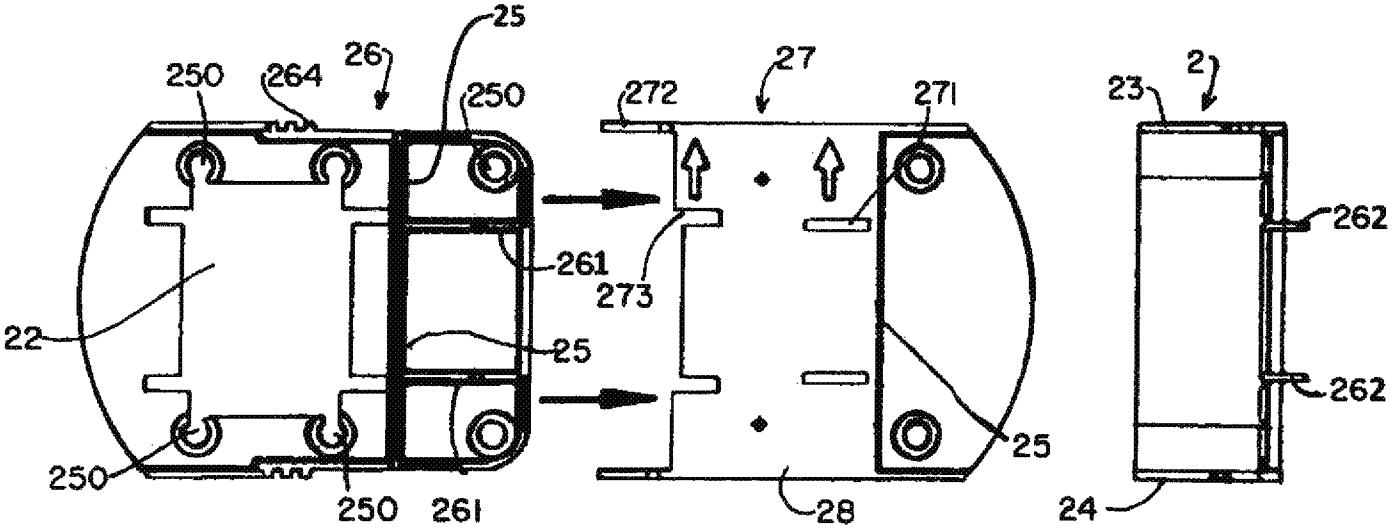
FIG. 8E is a rear view of detail (b) of FIG. 8B.
FIG. 8F is a rear view of detail (a) of FIG. 8B.
FIG. 8G is a side view of detail (a) of FIG. 8B.

One solution is depicted in FIGS. 8A, 8B. In this embodiment there is a longitudinal receiving locking piece 27 formed adjacent to each of the apertures 22. Each segment (6" in one preferred embodiment) of rigid support piece 2, has its own receiving longitudinal locking piece 27. As a result, the depicted system facilitates the cutting of the rigid support structure 2 at approximately 6" intervals, without undue inconvenience in longitudinally connecting the cut support structure 2 to an adjacent support structure 2. This facilitates far greater flexibility with the overall form system.

The locking device 3 (as depicted in FIGS. 7A-7C) is only one preferred method for holding the entire form structure (1, 2, 5) together with a substrate holder 5 (such as a stake or spike), the invention of the present system can still operate with other types of substrate support locking systems. For example, a conventional clamping system, such as that shown in the Appendix, and FIGS. 12, 13, 15, 19 and 22 can also be used to facilitate the invention represented by the overall concrete form system. The characteristics of conventional clamping systems 3 are already well known, as are substrate holders 5 (pipes, rebar, spikes), so that additional description of such devices is unnecessary for an understanding of the integration of various locking devices with the present invention.

One reason that connectivity of the two major components 1, 2 (faceplate, rigid support piece) of the present concrete form system is managed so easily is that there are multiple points of contact between components 1, 2 so that stress is easily distributed, and there are no single points at which most of the stress can build up between the interconnected components 1, 2 due to the external forces (in particular, from the concrete pour) placed upon the form system. As previously discussed, multiple connecting prongs 150 and receiving apertures 250 are used to hold the flexible faceplate 1 to the rigid support piece 2 along the respective lengths of both pieces 1, 2. The use of the ring holder 11 structure also serves to distribute stress throughout the overall form system rather than putting particular stress at any one connection point. The respective structures of both flexible faceplate 1 and rigid support piece 2 are also configured so as to distribute stress as much as possible, thereby avoiding destructive stress at any particular point in the system. In particular, the flexibility and multiple connecting prongs of the flexible faceplate 1 help to facilitate distributed stresses (as opposed to stress concentrated at one or two points) whether used with rigid support piece 2, or only with the support of substrate holding pieces 5.

Figure 1D:
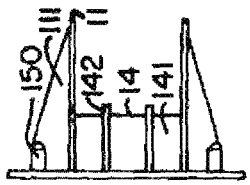
FIG. 1D is a side view of detail A from FIG. 1B, depicting a substrate support connector.
Figure 1E:
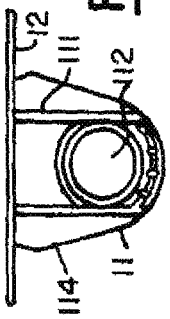
FIG. 1E is a top view of detail A from FIG. 1B, depicting a substrate support connector.

To better accommodate the extensive use and benefits of substrate holding pieces 5 without the use of rigid support pieces 2, one embodiment of flexible faceplate 1 (as depicted in FIGS. 1B, 1C) includes the use of a spacer structure 14. This structure is constituted by intersecting vanes 141, 142, arranged perpendicular to each other. The first vein 141 extends between the two ring holders 11, as depicted in FIG. 1D. A set of two transverse veins 142 extend perpendicular to the first vein 141. The resulting structure stiffens the flexible faceplate 1 at a point of potential high stress, along the length of substrate holding piece 5. The spacer structure 14, also keeps the relationship between flexible faceplate 1 and substrate holding piece 5 uniform and stable.

Another area where high stresses could potentially be destructive is found at the longitudinal connectors joining two rigid support pieces 2. As previously indicated, there is a protruding or male longitudinal locking piece 26 at one end of each rigid support piece 2, and at least one receiving, or female longitudinal locking piece 27 on each rigid support piece 2. The receiving longitudinal locking piece 27 is sized to accommodate the protruding longitudinal locking piece 26 in a sleeve-like, close-fitting manner, which can easily be disconnected by pulling the two rigid support pieces 2 apart. The sleeve-like action of the receiving longitudinal locking piece 27 on the protruding longitudinal locking piece 26 holds the two rigid support pieces 2 together against transverse forces (such as those caused by a concrete pour) while facilitating easy assembly and disassembly of the two connected rigid support pieces 2.

Because both of the longitudinal connecting, or locking pieces 26, 27 of rigid support piece 2 are potential sources of failure, both of these longitudinal connecting/locking pieces 26, 27 are reinforced by transverse walls 25 and parallel ribs 261 to form a honeycomb-like support structure. On the protruding longitudinal locking piece 26 ribs 261 (which run parallel to the longitudinal walls 23, 24 of rigid support piece 2) have sawtooth prongs 262. These interface with holding slots 271 of receiving longitudinal locking piece 27 to firmly hold 26 and 27 together.

The protruding longitudinal locking piece 26 also has a plurality of ribs 261 with prongs 262 configured to facilitate a friction fit with holding slots 271. This friction fit arrangement is used so as to avoid difficulties during the assembly and disassembly of the protruding and receiving connectors 26,27, while still enhancing the security between the protruding longitudinal connector 26 and the sleeve-like receiving longitudinal connector 27.

The protruding longitudinal connector 26 also has upper and lower ribs 264 extending from both longitudinal surfaces 23, 24. These flat ribs serve to interact with complementary semi-circular indents 272 on the upper and lower longitudinal walls 23, 24 of the sleeve-like receiving longitudinal locking piece 27. These flat ribs 264 serve as locks to prevent lateral twisting that might be caused from perpendicular forces generated by a concrete pour. The sleeve-like connection between the protruding longitudinal connector 26 and the receiving longitudinal connector 27 helps to distribute the stresses from external factors, such as the weight of the concrete pour, or rough handling on the construction site. The friction fit pieces 263 also help to do this by providing additional contact points to add a tight friction fit. Further, the saw-tooth prongs 262 from upper and lower ribs 261, interact with holding slots 271 on the opposite or back wall 28 of the receiving longitudinal connector 27 so as to add further support against any twisting on perpendicular stresses that might be developed from above or below the longitudinal surfaces 23, 24 of the rigid support pieces 2.

In one embodiment of the present invention the rigid support piece 2 is configured so that a receiving longitudinal connector 27 is found every six inches along the length of the rigid support piece 2. This structure permits easy adjustment of rigid support piece 2 by cutting at the apex of any of the semi-circular indents 241, 231. By using the center of these indents as cut points, the correct segment lengths of rigid support piece 2 can be obtained. The length is such that a receiving longitudinal connector 27 will be available at the cut end of the rigid support piece segment. It is crucial that a complete receiving longitudinal connector 27 be used when two segments of rigid support pieces 2 are joined together because the concrete form system is particularly vulnerable at the longitudinal connections points.

Angled connections between rigid support pieces 2 (such as 90° angles) are also particularly vulnerable since the concrete pour will exert stresses in two directions rather than one. As a result, additional stresses can be generated at the connection point, serving to tear forms apart at a 90° (or other) angle. 90° angles are also problematic in that complex concrete configurations can require a number of perpendicular sides within a relatively small space. This can make the stresses on the multi-angled concrete form arrangement particularly problematical. Further difficulties are added since conventionally, 90° angles are fabricated from straight lengths on the job site. The result is a lack of uniformity in structural performance, and the loss of substantial time to rig the 90° angles on the job site with whatever materials are at hand. As a result conventional arrangements are expensive (in terms of lost time as in skilled labor), non-uniform and unreliable.

Figure 18A:
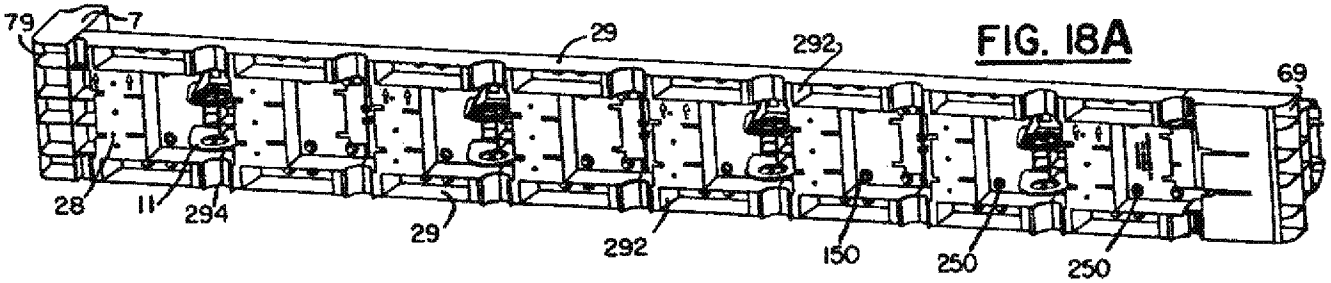
FIG. 18A is a perspective view of a variation of the embodiment of FIG. 17A.
Figure 18B:
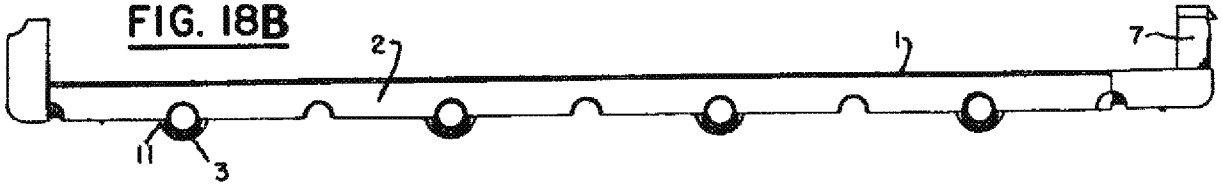
FIG. 18B is a top view of the arrangement of FIG. 18A, including two inside corner pieces.

These difficulties are addressed using preformed corner pieces as depicted in FIGS. 10A-10E, and FIGS. 11A-11F. These drawing depict inside corners 6 (in which the form is inside of the concrete pour) and outside corners 7 (in which the pour is inside the concrete form), respectively. FIG. 12 depicts both the inside and outside corners arranged with a concrete form configuration. FIGS. 18A-18B depicts an arrangement with two outside corner 7 configurations at either end of a rigid support piece 2. A key attribute of both the inside and outside corner pieces 6, 7 is that they fit easily on to both the receiving and protruding longitudinal locking pieces 26, 27 of the rigid support piece 2.

Because of the additional stresses placed on the corner pieces (6, 7), the present invention provides a more robust arrangement, as depicted in FIGS. 10A-10E and 11A-11F. In particular, the sleeve-like arrangement (of lateral walls and longitudinal walls) and holding slots 271 used with the receiving longitudinal locking device are all present in both corner pieces 6, 7.

Figure 10B:
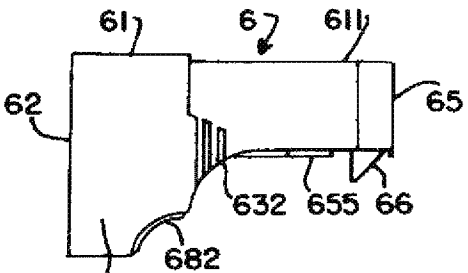
FIG. 10B is a top view of the inside corner piece of FIG. 10A.
Figure 10A:
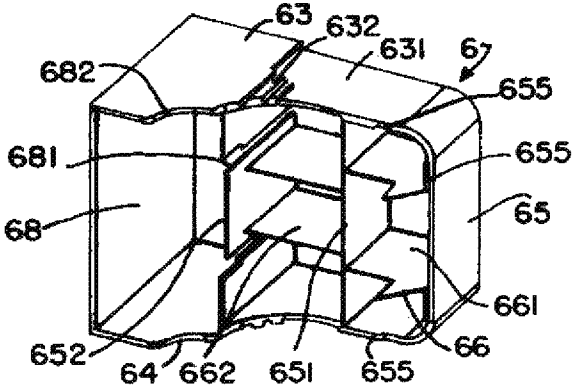
FIG. 10A is a perspective view of an inside corner piece of the present invention.
Figure 11F:
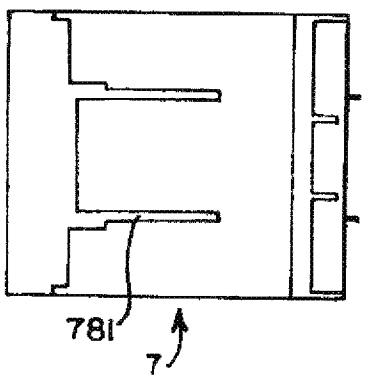
FIG. 11F is a left side view of the outside corner piece of FIG. 11A.
Figure 11E:
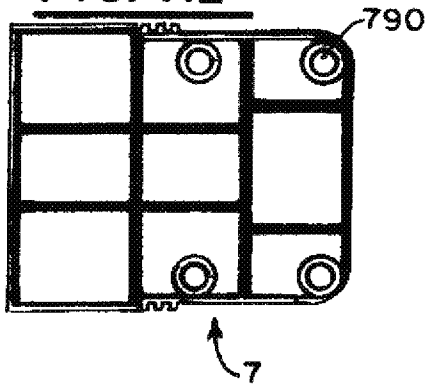
FIG. 11E is a right side view of the outside corner piece of FIG. 11A.

As depicted in FIG. 10A inside corner piece 6 includes a receiving sleeve 68 with upper and lower longitudinal walls 63, 64. Faceplates 61, 62 are configured to receive concrete pour, and also serve to form the sleeve-like structure 68. Like the receiving longitudinal locking piece 27, the sleeve-like structure 68 includes walls 652 having holding slots 681.

On the opposite end of 6 locking the protruding section 65 begins with parallel support walls 662 extending to transverse support walls 651, which attach to parallel supporting walls 661, from which the sawtooth structures 66 extend. The entirety of this honeycomb-like structure is enclosed at the distal end by transverse wall 659. The result is a structure supporting the protruding longitudinal locking portion 65 to better withstand the stresses that will be exerted by a concrete pour.

Facing surface 61 is raised from surface 611, which accommodates the thickness of a flexible faceplate 1 that will be connected to the inside corner piece 6 using receiving apertures 690. The front surface of the flexible faceplate (not shown) will be even with surface 61 to present a smooth overall surface to the concrete pour. To provide further stability at the connection between inside corner piece 6 and a rigid support piece 2 to be connected thereto, protruding longitudinal locking piece 65 will interact with a receiving longitudinal connector 27 on a rigid support piece 2, as described supra.

To further prevent undesirable twisting of the rigid support piece 2 (not shown) and inside corner piece 6, ribs 632 are provided on upper offset surface 631. These ribs 632 will interact with a semi-circular indents 241, 231 on the receiving longitudinal connector 27 of rigid support piece 2. The semi-circular indent on the rigid support piece 2 will be exactly the same as indent 682 on the sleeve-like receiving portion 68 of the inside corner piece 6. The combination of the semi-circular indent and rib 632 add substantial stability to the overall connected arrangement.

Other structures adding enhanced stability to the connection between inside corner piece 6 and associated rigid support piece 2 include friction fit pieces 655. These are protrusions that extend slightly above the edge surface of protruding longitudinal connector 65 at selected positions. These positions are selected so that the friction pieces 655 do not interfere with the connection (or disconnection) of inside corner piece 6 and rigid support piece 2, but once the two pieces 1, 2 are fit together help to make the connection more secure against the perpendicular forces exerted by the concrete pour. Likewise, flat ribs 264 on the protruding longitudinal connector 26 of rigid support piece 2 (not shown) is configured to fit around semi-circular indent 682 to provide increased stability by preventing extensive rotation of the two pieces 2,6.

In structural terms the outside corner 7 differs from inside corner 6 based upon the orientation of the smooth faces which are to face the concrete pour. Otherwise, in functional terms, the two corner pieces 6, 7 are essentially identical. Both have receiving longitudinal locking devices and protruding longitudinal locking devices. The same structures described supra with regard to inside corner 6 are also used on outside corner 7.

One additional structure is apparent, an additional layer of honeycomb-like support structure. This "honeycomb" structure includes parallel support walls 773 and end wall 774. This structure provides additional support for the overall outside corner piece 7. The "honeycomb" structure of parallel support walls and transverse walls used in both the inside and outside corner pieces 6, 7 result in a very light-weight structure having sufficient strength to withstand the pressures exerted by large concrete pours.

Because the corner pieces 6, 7 are relatively small, it is possible to create a complex arrangement of right angles in a relatively small space. In one embodiment currently in use, the outside corner piece 7 is approximately 4½" by 4¾" in its two longitudinal directions. The inside corner piece 6 is approximately 4½" by 3" in its two longitudinal directions. However, other sizes can be accommodated within a concept of the present invention. One crucial aspect of the present invention is that both the longitudinal connectors 26, 27, and the longitudinal locking devices on the corner pieces 6, 7 are used to distribute stress through the use of numerous contact points between the two pieces being connected together, whether rigid support pieces 2 or corner pieces 6, 7.

It is well-known that large concrete pours generate substantial pressure on the forms used to contain and shape those pours. This becomes especially problematical when long, straight edges are required for the pour. This puts additional stress on the concrete forms, and usually additional reliance upon substrate holding devices 5, and the portions of the ground or substrate that support them. When sufficient points of support on the substrate cannot be found, additional reliance on the strength of the rigid support pieces 2 has to be made.

One solution to this problem is depicted in FIGS. 17A-17C, FIGS. 18A-18B, FIGS. 20A-20E, and FIGS. 21A-21F. The key additional structure is constituted by support channels 29 formed above and below the previously described rigid support structure 2. Each of upper and lower support channels 29 contains a plurality of cylindrical holding structures 291. These are used to hold lateral supports such as pipes, reinforcing rods and other cylindrical structures to stiffen the length of rigid support piece 2. The preferred reinforcing device is a plastic pipe (not shown), approximately ½" to ¾" in diameter. However, other elongated support structures can be put into support channel 29 to strengthen rigid support piece 2.

In an alternative to the first embodiment using support channels 29, an elongated support pipe or rod (not shown) need not be used. Rather, the entire support channel 29 can be strengthened and stiffened through the use of lateral walls 292, placed at predetermined intervals along the length of the support channel 29. Likewise, a combination of both reinforcing rods (not shown) held by cylindrical holding structures 291, and lateral support walls 292 can be used. In such a circumstance, there would be stretches of support channel 29 in which there was room for the support rods (not shown), while other stretches along the length of the support channel 29 would be periodically reinforced by lateral support walls 292.

The first preferred embodiment includes transverse walls 292 at each indent 294 as depicted in FIG. 18A. The transverse walls 292, flanking each indent 294 (which also has its own semicircular walls) provide a sufficiently rigid structure so that external reinforcing pipes (not shown) are not needed, as would be required in the embodiment of FIG. 17A. this first embodiment permits the overall concrete form system to be more self-sufficient, eliminating the need to find approximately sized reinforcing pipes or tubes that can be accommodated by semicircular holding pieces 292 (as depicted in FIG. 17B).

While either of the preferred embodiments of FIGS. 17A and 18B, respectively, can be used, the present invention is not confined thereto. Rather, a hybrid of the two arrangements is also possible. Because the present system lends itself to easy sectionalization, a first section using the external reinforcing tubes (not shown) facilitated by the embodiment of FIG. 17A can be easily connected to a section configured as depicted in FIG. 18A. as a result, the advantages of both types of reinforcing arrangement can be applied by the users of the concrete forms.

Inside and outside corner pieces 6, 7 can also be modified in accordance with the support channel 29 embodiment. These support channels 69, 79 are simply added to the tops and the bottoms of the inside and outside corners 6, 7 along an upper surface of the sleeve-like structure 68, 78, which would receive a protruding longitudinal locking device (65, 75, 26). The support channels 69, 79 on the inside and outside corner pieces 6, 7 can be hollow structures having no other function than to provide a smooth upper surface to merge into that of the support channel 29 of the rigid support piece 2. However, support channels 69, 79 can also be supported by an interior "honeycomb" structure (not shown). Likewise, cylindrical holding structures 291 can also be placed in channels 69, 79 to accommodate a support rod or pipe (not shown). Such variations in the structure of the corner pieces can easily be accommodated by special production runs the plastic manufacturing facility providing the inventive concrete form system.

The present invention provides a contiguous, stable, apparently seamless interface between straight, rigid concrete forms and flexible curved forms, as depicted in FIG. 22. This capability is provided by the combination of multi-point connections distributing stress throughout the entire form system. This distribution is carried out using the two connection systems between the flexible faceplate 1 and rigid support piece 2. Connections between the substrate and the combined system (1,2) also provide support and external stress distribution of the system. As a result, the flexible faceplates 1 can be extended from the rigid support piece 2, as depicted in FIG. 22, without any compromise to the structural integrity of the overall concrete form system. The structural integrity is also maintained through the distributed stress features of the various types of longitudinal connectors found in both the rigid support pieces 2 and the corner pieces 6, 7. As a result, the overall system can withstand the substantial stresses generated by the weights of a wide variety of large and complex concrete pours. To accomplish the same things, conventional systems would require substantial amounts of on-site construction, and improvised parts fabrication, often resulting in non-uniform end products. On the other hand, using the present inventive system, assembly of even a complex concrete form system is done easily, thereby saving substantial amounts of money, and insuring a uniform reliable end product.

The overall flexibility of the present system is provided by the flexible faceplate 1. While this part of the system is made in 4 inch wide strips, 6 inch wide strips can also be made to accommodate 6 inch wide rigid support pieces 2 with support channels 29. FIG. 16 depicts a 6" wide flexible faceplate 1 configured for use with rigid, support pieces 2 having support channels 29. Additional apertures 250 (on rigid support piece 2) are used to accommodate the additional connecting prongs 150, depicted in FIG. 16.

It should be noted that there are additional receiving apertures 160 located on flexible faceplate 1 at the upper and lower edge portions that would correspond to the areas of support channels 29. These additional apertures 160 can accommodate connections for adjacent, overlapping faceplates (not shown). It should be understood that the additional connecting prongs 150, and receiving apertures 160 provide additional connections that can be utilized to further distribute stresses on the overall system. Thus, the support channel 29 embodiment of the present invention provides additional strength beyond that provided by external horizontal support pipes or rods (not shown), that can be placed in the support channels 29.

The present invention is not confined to the 4 inch and 6 inch widths depicted in the drawings. Rather, only the art of plastic manufacturing the limits the size of either the faceplates 1 or the rigid support pieces 2. Accordingly, flexible faceplates 1 could be manufactured to be 24 inches in height having six sets of stacked support rings 11 configurations.

These wide, flexible faceplates 1 could be used on a stack of rigid support pieces 2, which can be stacked on top of each other to virtually any height due to the lips 242, and the presence of flexible faceplates 1, in conjunction with substrate holding devices 5. Further, the sizes of the rigid support pieces 2 are not confined to 4 inches and 6 inches. Rather, much wider and longer structures can be made besides the 4 and 6 inch width, 4 foot long embodiments depicted in the drawings. The sizes of the rigid support pieces 2 are confined only by plastic manufacturing technology. For the sake of construction standards and manufacturing effectiveness, the preferred embodiments depicted are confined to 4" and 6" widths for both the rigid support pieces and the flexible faceplates 1.

Consequently, stacking is required if taller concrete configurations are to result from the pour. The stacking can be done using rigid support pieces 2 in combination with flexible faceplates 1, or with only flexible faceplates 1. Both arrangements benefit substantially from substrate holders 5 of various types. However, vertical support rods (not shown) held by the ring holders 11 can be used without the capability of holding onto the substrate. Rather, such support rods or pipes would merely help hold the stacked configuration together, while other means are used to hold the overall form arrangement to a desired place on the substrate. Examples of such substrate holders could be existing curbs or other concrete structures, wooden frameworks, stakes of various types, and even banked dirt or gravel. The final arrangement will depend upon the nature of the substrate and the overall characteristics of the job site. Stacking of flexible faceplates 1 is depicted in FIGS. 13 and 15.

Stacking of a combination of rigid support pieces 2 and flexible faceplate 1 is depicted in FIG. 22. The use of the arrangement in FIG. 22 provides the strongest and most flexible arrangement, combining both flexibility and a high level of rigidity. However, concrete arrangements don't always admit to the combination of straight lines and curved forms provided by the arrangement of FIG. 22.

In some cases, only curved concrete structures are desired. Examples are including in the attached Appendix. A continuous curve required for the resulting concrete structure means that only curved forms can be used, such as depicted in FIGS. 13 and 15. The example of FIG. 15 is a form configuration for a concrete column. To create the form arrangement of FIG. 15, there is slight overlap between connecting flexible faceplates 1. However, because the flexible faceplate is generally less than ⅛ inch in thickness, the offset in the resulting concrete face is slight, and can easily be smoothed down for a smooth concrete finish afterwards. Such smoothing operations (usually by grinding) are a common part of any fancy or smooth finish concrete work, and so does not constitute an additional burden when using the form system of the present invention.

Figure 15:
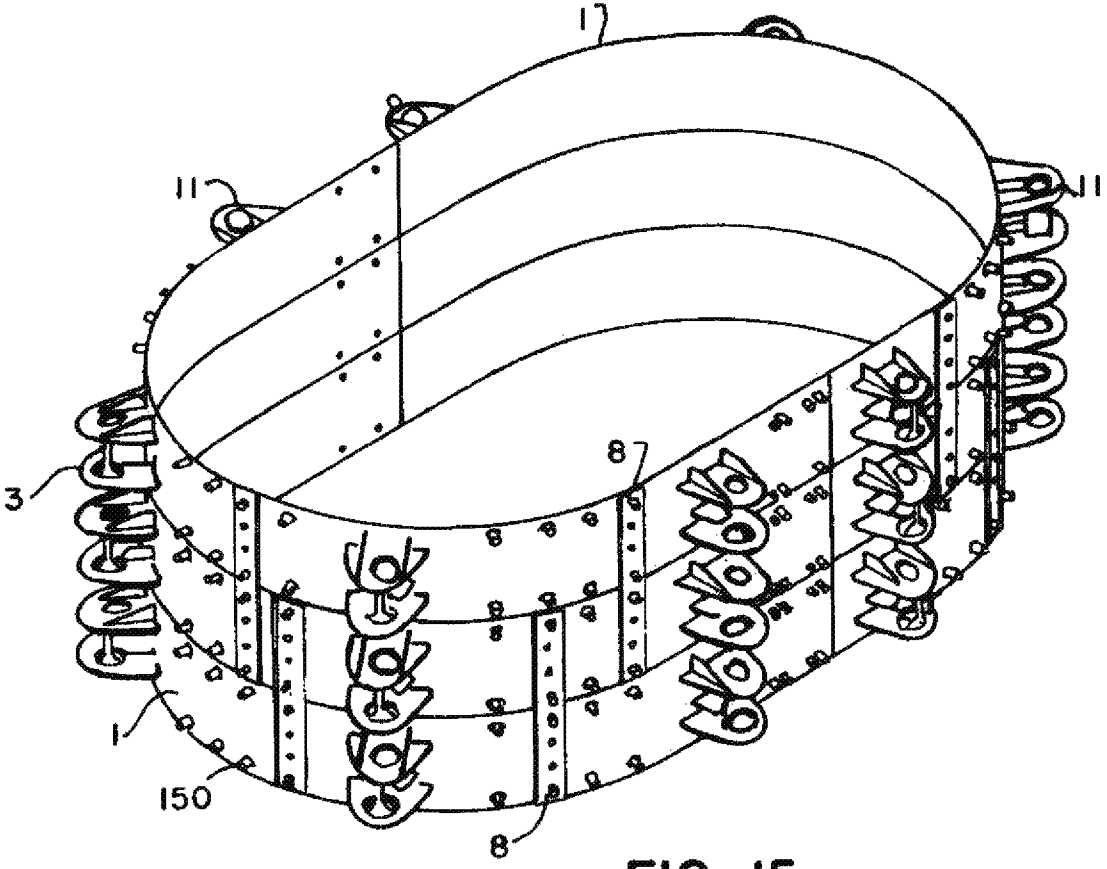
FIG. 15 is perspective view depicting a column-like stacked concrete form configuration in accordance with a further embodiment of the present invention.

Structural support for the curved configurations of FIGS. 13 and 15 is provided by substrate holding pieces (not shown) such as stakes extending through the sets of holding rings 11. Yet another connecting system is used to hold the stacked faceplates 1 together. Connector strips 8 hold vertically adjacent flexible faceplates 1 to each other. Connecting strips 8 can be the entire height of the stacked formation, or they may be confined to the combined width of only two flexible faceplates 1 (8 inches).

While the connecting strips 8 are shown as being approximately 1 inch in width, they can be made much wider (with multiple lines of apertures 81) so that the width accommodates multiple horizontal connecting prongs 150. The use of the wider connecting strips 8 to accommodate at least two laterally placed apertures 81 (perpendicular to the longitudinal axis of the strip) would be necessary to connect the edges of two flexible faceplates 1 for the arrangements depicted in FIGS. 13 and 15. The apertures 81 in the double wide connecting strip 8 would be sized to receive connecting prongs 150, and would be spaced in accordance with the pattern of the connection system used throughout the previously described system of connecting prongs 150 and receiving apertures 160 used throughout all of the variations of the aforementioned concrete form system.

In any arrangement using only flexible faceplates 1, such as the embodiments of FIGS. 13 and 15, may require additional support and bracing. In some cases, a double width support strip 8 is adequate to hold the horizontally adjacent flexible faceplates 1 together, as depicted in FIG. 15. However, such support is somewhat limited. Further, even double width supporting strips 8, running from the top of the stacked faceplates 1 to the bottom, may not be sufficient to support the overall concrete form structure. This is especially true if open ends are left, such as those in the configurations of FIGS. 13 and 22. In some configurations, without the use of rigid support pieces 2, additional types of support may be required.

For example, connector plate 9, as depicted in FIG. 19, can be used to provide an overlap between two horizontally adjacent flexible faceplates 1, and to provide the support from an additional substrate holding piece 5 (using holding rings 11), wherever such additional support is needed. It should be noted that while receiving apertures 160 are depicted in FIG. 19, connecting plate 9 can also be configured with extending prongs 150 (not shown in FIG. 19, but depicted in FIG. 1D). This arrangement would provide greater flexibility in the connections between the connector plate 9 and the flexible faceplates 1, and provide enhanced connection support.

Connector plate 9, as depicted in FIG. 19, can be used to provide substrate support (via stakes 5) for other types of concrete form system, as well as the inventive system described supra. Receiving apertures 160 can be used for pass-through connectors such as nails and screws, to connect connector plate 9 to other types of forms such as wooden studs, and the like. Using such external connectors such as nails (not shown), and external forms from other types of systems (such as wooden studs), connector plates 9 can be used to integrate the faceplates 1 of the inventive concrete form system with the forms other types of concrete form system. Further, the integrated systems are supported by stakes 5 driven through holding rings 11.

It should be clear that connector plate 9 is constructed in the same manner as a flexible faceplate 1, but with a single set of holding rings 11. The configuration of connector plate 9 allows it to be placed virtually anywhere on a concrete form system of virtually any type to provide additional support by means of substrate support devices (not shown), such as stakes that are driven into the substrate, and are held by the holding rings 11.

While constrained in size, each connector plate 9 contains two different connection systems. The first is constituted by receiving apertures 160, which can be used for either external connectors, or extending prongs 150 from other pieces of one of the variations of the concrete form systems previously described. The second connection system is constituted by the pair of holding rings 11. These can be interfaced with a rigid support piece 2, such as that described previously, to provide additional support to a concrete form system using a combination of flexible face plates 1 and rigid support pieces 2. However, the second connection system is most important because it can hold substrate support devices such as stakes, rods, pipes, spikes and the like. These provide additional support for virtually any type of concrete form system to which connector plate 9 can be added.

Part of the adaptability of the overall system previously described is that matching lengths of flexible faceplates 1 and rigid support pieces 2 are not necessary for the operation of the overall concrete form system. Rather, differing lengths of both types of concrete form pieces 1,2 allow the desired configuration of the ultimate concrete pour to be determined to the satisfaction of the users. Consequently, there may be situations in which rigid support pieces 2 have a length such that too many apertures 22 (as depicted in FIG. 2A) are present. In such cases, a connector plate 9, or multiple collector plates, can be applied to the rigid support piece 2 until a desired configuration and pour face are achieved. In this manner, connector plates 9 can serve as a low-cost finishing piece in the overall concrete form system.

Because connector plate 9 relies upon the highly flexible faceplate structure to support holding rings 11, the additional structural support provided by spacer structure 14 is especially important. Additional strength of the holding rings 11 is further accomplished by transverse supports 111, and edge pieces 114. All of the support and spacing structures ensure that the strength provided by the substrate support device 5 (not shown) is fully achieved by connector plate 9, thereby supporting an external concrete form structure attached to connector plate 9. Further strength is provided by clamp structure 310, which forces substrate support device 5 against spacer structure 14.

Clamp structure 310 forces substrate support device 5 against the inner edges of holding rings 11, and against spacer structure 14. Accordingly, spacer structure 14 must be sufficiently robust to endure this added pressure. This is achieved by a vertical vane 141 extending from the surface of the flexible piece between the two holding rings 11. Additional support is provided by a set of two transverse pieces 142. These extend on either side of the vane 141. Taken as a whole, this structure provides the necessary strength for spacer structure 14 to maintain connector piece 9 as a viable support structure.

While the cylindrical configuration of FIG. 15 is depicted as being without the benefit of rigid support pieces 2, the rigid support pieces 2 are not necessarily excluded from this configuration. Rather, rigid support pieces be added as a square or rectangle around the circular or obloid configuration formed by flexible faceplates 1. Such an arrangement of rigid support pieces 2 would only contact the flexible faceplates 1 at a few points within the square or rectangle. However, this could provide an additional level of structural support to accommodate the forces generated by increasing larger concrete pours. Because of the corner pieces 6, 7, a very strong rigid support piece 2 structure can be easily made to quickly provide additional support for the curved flexible faceplate configuration. Additional support can be provided by the use of additional connector pieces 9, which can be placed at various portions of the concrete form system, as needed.

Such additional support configurations using the rigid support pieces 2 are not depicted in the drawings since the many variations that would occur or be necessitated on a concrete pour job site is too large and variable for purposes of describing the present invention. It is sufficient to understand that in many cases the rigid support pieces 2, in conjunction with substrate holding pieces 5 or other structural support means could be used as a substitute for much of the temporary structural support that is provided by improvised wooden structures on current job sites. Further, while the wood for such support is usually lost or rendered useless, rigid support pieces 2 can virtually always be retrieved and reused, as can the flexible faceplates 1. The same is true for connector pieces 9. These can be used with wooden concrete form systems, and be fit for many reuses long after the wood portions of the concrete form system must be discarded.

While a wide variety of different form configurations and uses are found in Appendix 1 attached hereto, the uses of the present invention are not limited thereto. Any concrete form arrangement that would benefit from both rigid structural parts and flexible structural parts are potential applications for the present invention. A wide variety of very complex arrangements can be provided using very little time, and requiring very little skill on the part of the installers. This is a drastic divergence from the conventional techniques that often requires skilled carpenters to effect the desired form arrangement. An important aspect of the present invention is that the conventional awkwardness at the interface between straight forms and curved configurations is entirely eliminated, without the application of exceptional skill or the expenditure of substantial time.

While a number of embodiments have been described to provide examples, the present invention is not limited thereto. Rather, the present invention should be construed to include any and all modifications, adaptations, permutations, variations, derivations, and embodiments that would occur to one skilled in this technology in consideration of the present disclosure. Accordingly, the present invention should be interpreted as being limited only by the following claims.

I claim:

1. A concrete form support system arranged to support external concrete forms to a substrate, said concrete form support system including at least one discrete connection piece, each said connection piece comprising:

a) a flexible plate having a first front surface, and a rear side surface opposite said first front surface, and;

b) two connection systems, wherein;

i) a first connection system comprises at least one aperture extending through said flexible plate; and, ii) a second connection system comprises a substantially parallel double circular ring structure sized to hold an external substrate support device, said circular rings being separated from each other by a spacer structure extending from said rear side surface of said flexible plate, and said spacer structure being configured to extended adjacent to an external substrate support device when said external substrate support device is placed in said circular rings.

2. The concrete form support system of claim 1, wherein said flexible plate and said double circular ring structure are integrally formed of the same material.

3. The concrete form support system of claim 2, wherein said flexible plate is substantially ⅛ inch thick.

4. The concrete form support system of claim 2, wherein said external substrate support device comprises a cylindrical stake sized to fit within said double circular ring structure when said stake interfaces with said substrate.

5. The concrete form support system of claim 4, further comprising:

c) an external clamp structure configured to fit within both said double circular rings.

6. The concrete form support system of claim 5, wherein said external clamp structure comprises a screw structure configured to exert force on said external stake when said external stake is within said circular rings.

7. The concrete form support system of claim 6, wherein said screw structure forces said stake against said spacer structure.

8. The concrete form support system of claim 3, wherein said substantially parallel double circular ring structure comprises at least two circular rings, each said circular ring comprising: two lateral edge pieces extending from said rear side, and two transverse supports extending from said rear side.

9. The concrete form support system of claim 2, wherein said spacer structure comprises a single vertical vane extending between each said circular ring of said substantially parallel double circular ring structure, and a pair of lateral vanes, perpendicular to said vertical vane, and separated from each other.

10. The concrete form support system of claim 2, wherein said first connection system comprises a plurality of apertures extending through said flexible plate, wherein said apertures are sized to accept external prongs from external concrete form systems.

11. The concrete form support system of claim 10, wherein said first connection system further comprises at least one extending prong sized to fit within said apertures extending through said flexible plate.

12. The concrete form support system of claim 2, wherein said system comprises a plurality of said connection pieces, wherein said apertures on each said connection piece share a uniform pattern and spacing arrangement.

13. The concrete form support system of claim 12, wherein each said connection piece comprises a plurality of extension prongs, wherein each said extension prong is of uniform size and arranged at a uniform spacing.

14. The concrete form support system of claim 2, wherein said external concrete forms comprise wood.

15. The concrete form support system of claim 2, wherein said external concrete forms comprise plastic.

16. The concrete form support system of claim 13, wherein said external concrete form comprises a plurality of extension prongs corresponding to said apertures on said connection piece.

17. The concrete form support system of claim 16, wherein said external concrete forms comprise apertures corresponding to said extension prongs on said connection piece.

* * * * *